US011048198B2

(12) United States Patent
Doda et al.

(10) Patent No.: US 11,048,198 B2
(45) Date of Patent: Jun. 29, 2021

(54) IMAGE FORMING APPARATUS

(71) Applicant: CANON KABUSHIKI KAISHA, Tokyo (JP)

(72) Inventors: Kazuhiro Doda, Yokohama (JP); Tsuguhiro Yoshida, Yokohama (JP); Yutaka Sato, Komae (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/709,271

(22) Filed: Dec. 10, 2019

(65) Prior Publication Data

US 2020/0192263 A1 Jun. 18, 2020

(30) Foreign Application Priority Data

Dec. 12, 2018 (JP) ..... JP2018-232833
Oct. 21, 2019 (JP) ..... JP2019-192136

(51) Int. Cl.
*G03G 15/00* (2006.01)
*G03G 21/00* (2006.01)
(Continued)

(52) U.S. Cl.
CPC ..... *G03G 15/5062* (2013.01); *B65H 7/14* (2013.01); *B65H 43/08* (2013.01); *G03G 15/5029* (2013.01); *G03G 21/0047* (2013.01); *G03G 21/10* (2013.01); *B65H 2553/27* (2013.01); *B65H 2553/41* (2013.01);
(Continued)

(58) Field of Classification Search
CPC ..... G03G 15/5058; G03G 15/6564; G03G 15/1675; G03G 15/5029; G03G 15/5062; G03G 21/10
See application file for complete search history.

(56) References Cited

U.S. PATENT DOCUMENTS

2011/0182606 A1* 7/2011 Okanishi ..... G03G 15/5058 399/66
2012/0141179 A1* 6/2012 Atsumi ..... G03G 15/6564 399/381
(Continued)

FOREIGN PATENT DOCUMENTS

JP 04-319970 A 11/1992
JP 06-161309 A 6/1994
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus comprises a plurality of sheet detection units, provided at different positions along a sheet width direction, configured to detect the sheet conveyed on a conveyance path. A controller determines, by using the plurality of sheet detection units, a presence or absence of a sheet being conveyed in each of a plurality of regions sectioned in the sheet width direction, and determines, based on input image data, a presence or absence of an image to be formed in each of the plurality of regions. The controller further determines, based on the above determination results, whether or not the image to be formed on the sheet being conveyed is to be formed with a deviation from the sheet, and controls an image forming operation in accordance with this determination result.

17 Claims, 23 Drawing Sheets

(51) Int. Cl.
*G03G 21/10* (2006.01)
*B65H 43/08* (2006.01)
*B65H 7/14* (2006.01)

(52) U.S. Cl.
CPC ..... *B65H 2553/822* (2013.01); *G03G 2215/00616* (2013.01); *G03G 2215/00721* (2013.01); *G03G 2215/00734* (2013.01); *G03G 2215/00759* (2013.01); *G03G 2215/00772* (2013.01); *G03G 2215/1652* (2013.01)

(56) References Cited

U.S. PATENT DOCUMENTS

2012/0328309 A1* 12/2012 Kihara ..... G03G 21/10 399/35
2014/0099135 A1* 4/2014 Hiratsuka ..... G03G 15/5054 399/66
2015/0212457 A1* 7/2015 Kanno ..... G03G 15/1665 399/66
2015/0220042 A1* 8/2015 Kanno ..... G03G 15/6564 399/45

FOREIGN PATENT DOCUMENTS

JP 2001-282016 A 10/2001
JP 2002-351197 A 12/2002

* cited by examiner

FIG. 6B

| SHEET REGION | S1 | | S2 | | S3 | | S4 | |
|---|---|---|---|---|---|---|---|---|
| SHEET REGION BOTH END DETECTION RESULT | – | 70a | 70a | 70g | 70g | 70f | 70f | – |
| | – | 0 | 0 | 1 | 1 | 0 | 0 | – |
| PROCESSING RESULT | 0 | | 0 | | 0 | | 0 | |
| DETERMINATION RESULT | NONE | | NONE | | NONE | | NONE | |

FIG. 6C

| SHEET REGION | S1 | | S2 | | S3 | | S4 | |
|---|---|---|---|---|---|---|---|---|
| SHEET REGION BOTH END DETECTION RESULT | – | 70a | 70a | 70g | 70g | 70f | 70f | – |
| | – | 1 | 1 | 1 | 1 | 1 | 1 | – |
| PROCESSING RESULT | 0 | | 1 | | 1 | | 0 | |
| DETERMINATION RESULT | NONE | | PRESENT | | PRESENT | | NONE | |

| | S1 | S2 | S3 | S4 |
|---|---|---|---|---|
| IMAGE PRESENCE OR ABSENCE | 0 | 1 | 1 | 0 |
| DETERMINATION RESULT | NONE | PRESENT | PRESENT | NONE |

| SHEET REGION | | S1 | S2 | S3 | S4 |
|---|---|---|---|---|---|
| DETERMINATION RESULT | SHEET PRESENCE OR ABSENCE | 0 | 1 | 1 | 0 |
| | IMAGE PRESENCE OR ABSENCE | 0 | 1 | 1 | 0 |
| DIFFERENCE | SHEET - IMAGE | 0 | 0 | 0 | 0 |
| IMAGE FORMING OPERATION | | CONTINUE | | | |

| SHEET REGION | | S1 | S2 | S3 | S4 |
|---|---|---|---|---|---|
| DETERMINATION RESULT | SHEET PRESENCE OR ABSENCE | 0 | 0 | 0 | 0 |
| | IMAGE PRESENCE OR ABSENCE | 0 | 1 | 1 | 0 |
| DIFFERENCE | SHEET - IMAGE | 0 | -1 | -1 | 0 |
| IMAGE FORMING OPERATION | | STOP | | | |

FIG. 11

| | CASE 1 | | | | | | CASE 2 | | | | | |
|---|---|---|---|---|---|---|---|---|---|---|---|---|
| | USER DESIGNATION : B5 | | | | | | USER DESIGNATION : A4 | | | | | |
| EMBODIMENT 1 | SHEET REGION | | S1 | S2 | S3 | S4 | SHEET REGION | | S1 | S2 | S3 | S4 |
| | DETERMINATION RESULT | SHEET PRESENCE OR ABSENCE | 0 | 0 | 1 | 0 | DETERMINATION RESULT | SHEET PRESENCE OR ABSENCE | 0 | 0 | 0 | 0 |
| | | IMAGE PRESENCE OR ABSENCE | 0 | 1 | 1 | 0 | | IMAGE PRESENCE OR ABSENCE | 0 | 1 | 1 | 0 |
| | DIFFERENCE | SHEET - IMAGE | 0 | -1 | 0 | 0 | DIFFERENCE | SHEET - IMAGE | 0 | -1 | -1 | 0 |
| | IMAGE FORMING OPERATION | | STOP | | | | IMAGE FORMING OPERATION | | STOP | | | |
| COMPARATIVE EXAMPLE 1 | IMAGE FORMING OPERATION : CONTINUE | | | | | | IMAGE FORMING OPERATION : CONTINUE | | | | | |

FIG. 13A
CASE 3
USER DESIGNATION : B5
EMBODIMENT 2
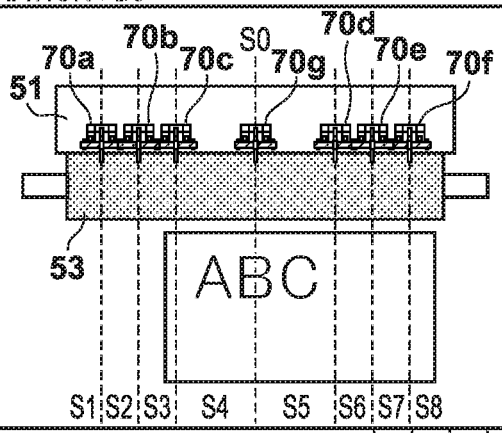
| SHEET REGION | | S1 | S2 | S3 | S4 | S5 | S6 | S7 | S8 |
|---|---|---|---|---|---|---|---|---|---|
| DETERMINATION RESULT | SHEET PRESENCE OR ABSENCE | 0 | 0 | 0 | 1 | 1 | 1 | 1 | 0 |
| | IMAGE PRESENCE OR ABSENCE | 0 | 0 | 0 | 1 | 1 | 0 | 0 | 0 |
| DIFFERENCE | SHEET - IMAGE | 0 | 0 | 0 | 0 | 0 | 1 | 1 | 0 |
| IMAGE FORMING OPERATION | | CONTINUE | | | | | | | |
EMBODIMENT 1
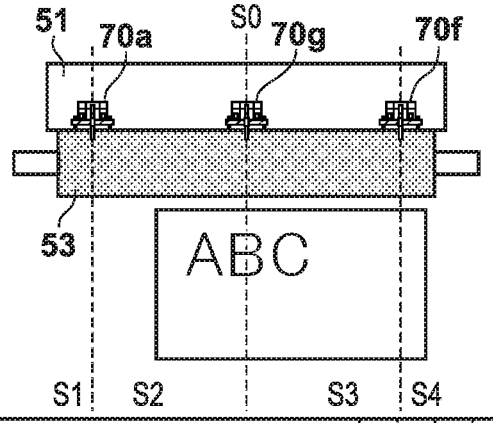
| SHEET REGION | | S1 | S2 | S3 | S4 |
|---|---|---|---|---|---|
| DETERMINATION RESULT | SHEET PRESENCE OR ABSENCE | 0 | 0 | 1 | 0 |
| | IMAGE PRESENCE OR ABSENCE | 0 | 1 | 1 | 0 |
| DIFFERENCE | SHEET - IMAGE | 0 | -1 | 0 | 0 |
| IMAGE FORMING OPERATION | | STOP | | | |

FIG. 13B
CASE 4
USER DESIGNATION : A4
EMBODIMENT 2
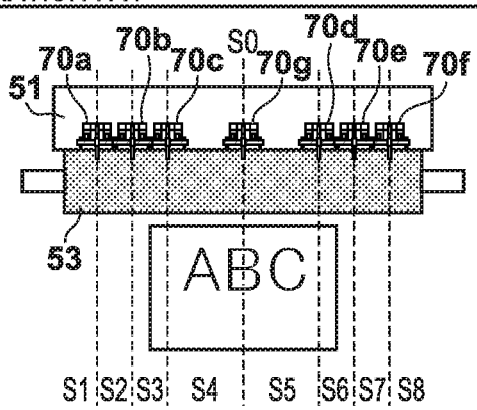
| SHEET REGION | | S1 | S2 | S3 | S4 | S5 | S6 | S7 | S8 |
|---|---|---|---|---|---|---|---|---|---|
| DETERMINATION RESULT | SHEET PRESENCE OR ABSENCE | 0 | 0 | 0 | 1 | 1 | 0 | 0 | 0 |
| | IMAGE PRESENCE OR ABSENCE | 0 | 0 | 0 | 1 | 1 | 0 | 0 | 0 |
| DIFFERENCE | SHEET - IMAGE | 0 | 0 | 0 | 0 | 0 | 0 | 0 | 0 |
| IMAGE FORMING OPERATION | | CONTINUE | | | | | | | |
EMBODIMENT 1
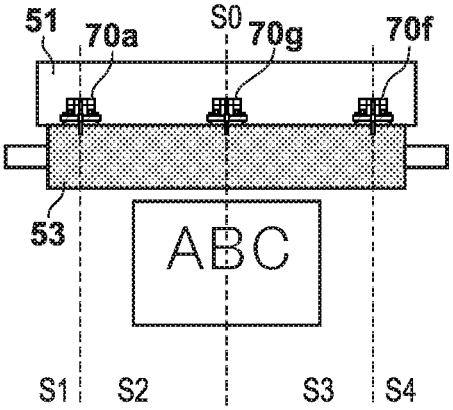
| SHEET REGION | | S1 | S2 | S3 | S4 |
|---|---|---|---|---|---|
| DETERMINATION RESULT | SHEET PRESENCE OR ABSENCE | 0 | 0 | 0 | 0 |
| | IMAGE PRESENCE OR ABSENCE | 0 | 1 | 1 | 0 |
| DIFFERENCE | SHEET - IMAGE | 0 | -1 | -1 | 0 |
| IMAGE FORMING OPERATION | | STOP | | | |

| SHEET REGION | | S1 | S2 | S3 | S4 | S5 | S6 | S7 | S8 |
|---|---|---|---|---|---|---|---|---|---|
| DETERMINATION RESULT | SHEET PRESENCE OR ABSENCE | 0 | 0 | 0 | 1 | 1 | 1 | 1 | 0 |
| | IMAGE PRESENCE OR ABSENCE | 0 | 0 | 1 | 1 | 1 | 1 | 0 | 0 |
| DIFFERENCE | SHEET - IMAGE | 0 | 0 | -1 | 0 | 0 | 0 | 1 | 0 |
| DETERMINATION | | THERE IS IMAGE DEVIATION | | | | | | | |

IMAGE FORMING APPARATUS

BACKGROUND OF THE INVENTION

Field of the Invention

The present invention relates to an image forming apparatus, such as a laser printer, a copier, a facsimile machine, and a multi-function peripheral, that uses an electrophotographic method.

Description of the Related Art

In an image forming apparatus, when an image to be formed on a fed sheet is transferred with a deviation from the sheet, fouling with developer (toner) may occur inside the apparatus. Japanese Patent Laid-Open No. 2001-282016 discloses a technique in which the size of the fed sheet in a conveyance direction is detected, and when the size detected is smaller than a designated size, a cleaning process is performed for a longer time than a normal case to thereby remove the toner that adheres to the transfer roller without being transferred to the sheet.

In the above-mentioned related technique, the cleaning process is controlled on the basis of the detection result of the size of the sheet in the conveyance direction. However, when an image is transferred with a deviation from the sheet in the sheet width direction orthogonal to the sheet conveyance direction, the image forming operation may not be appropriately controlled and fouling with the toner may occur inside the apparatus.

SUMMARY OF THE INVENTION

The present invention provides a technique for preventing the occurrence of fouling with toner inside an image forming apparatus due to an image transferring with a deviation from a sheet.

According to one aspect of the present invention, there is provided an image forming apparatus, the image forming apparatus comprising: a plurality of sheet detection units provided at different positions along a sheet width direction orthogonal to a conveyance direction of a sheet, the plurality of sheet detection units being configured to detect the sheet conveyed on a conveyance path; a first determination unit configured to determine, by using the plurality of sheet detection units, a presence or absence of a sheet being conveyed in each of a plurality of regions sectioned in the sheet width direction; a second determination unit configured to determine, based on input image data, a presence or absence of an image to be formed in each of the plurality of regions; a third determination unit configured to determine, based on a determination result of the first determination unit and a determination result of the second determination unit, whether or not the image to be formed on the sheet being conveyed is to be formed with a deviation from the sheet; and a control unit configured to control an image forming operation in accordance with a determination result of the third determination unit.

Further features of the present invention will become apparent from the following description of exemplary embodiments (with reference to the attached drawings).

BRIEF DESCRIPTION OF THE DRAWINGS

FIGS. 6A to 6C are diagrams illustrating an exemplary sheet determination process.

FIG. 11 is a diagram illustrating a comparison result.

FIGS. 13A and 13B are diagrams illustrating an exemplary condition for comparison with Embodiment 1 and a comparison result (Embodiment 2).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

Embodiment 1

<Configuration of Image Forming Apparatus>

Figure 1:
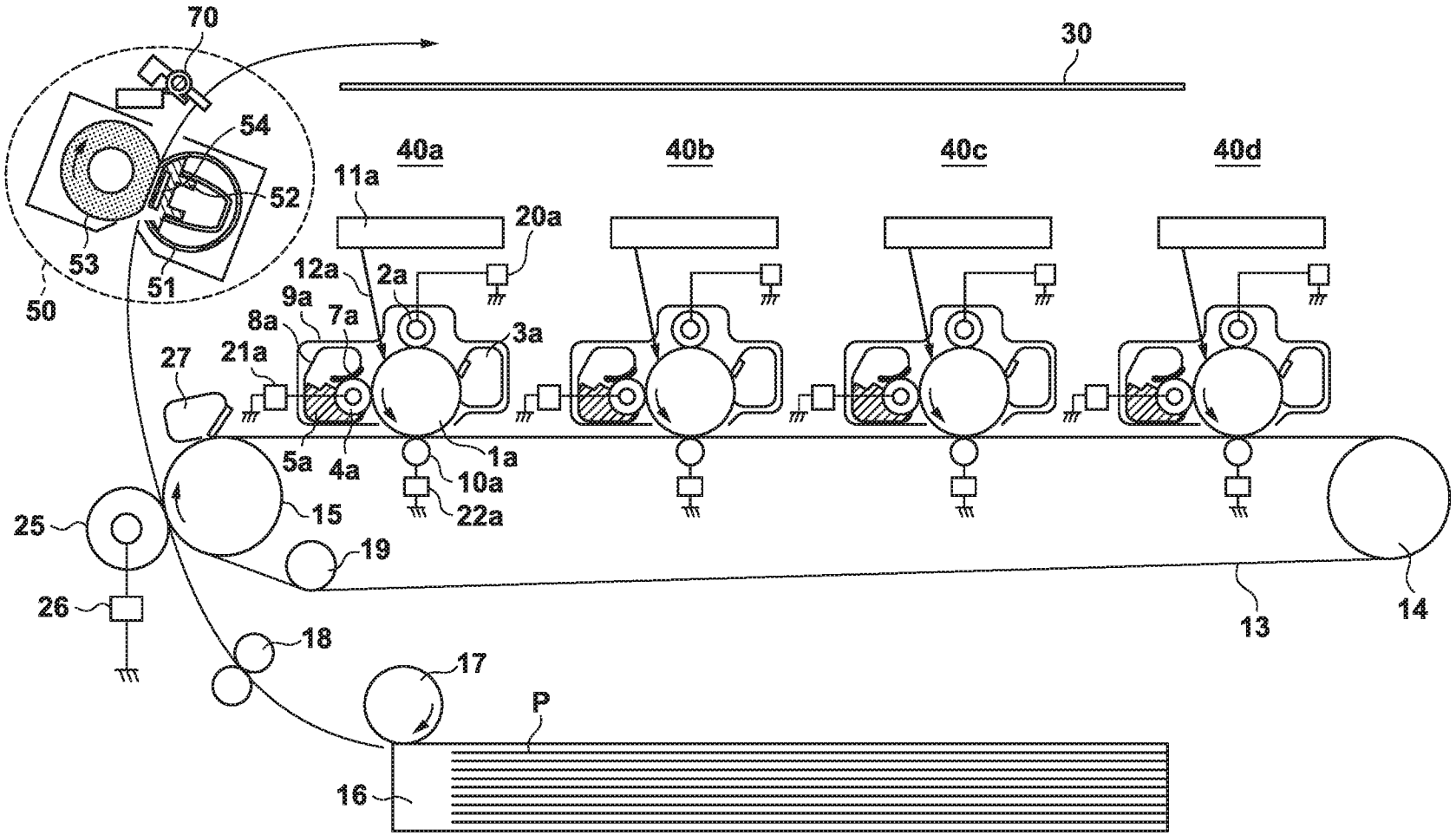
FIG. 1 is a sectional view illustrating an exemplary schematic hardware configuration of an image forming apparatus.

An in-line color image forming apparatus is described as an image forming apparatus of Embodiment 1. FIG. 1 is a cross-sectional view illustrating an exemplary schematic hardware configuration of the image forming apparatus of Embodiment 1. The image forming apparatus illustrated in FIG. 1 is an image forming apparatus that forms a multicolor image by electrophotography. Note that the present invention is applicable not only to an image forming apparatus that forms a multi-color image, but also to an image forming apparatus that forms a monochrome image (single color image).

Station

The image forming apparatus includes first to fourth stations 40*a*, 40*b*, 40*c*, and 40*d* that perform image formation by using toners (developers) of different colors. In the present embodiment, the first to fourth stations 40*a*, 40*b*, 40*c*, and 40*d* are stations for toner image formation of yellow (Y), magenta (M), cyan (C), and black (K), respectively. While the configuration of the first station 40*a* is described below, each of the second to fourth stations 40*b*, 40*c*, and 40*d* has the configuration similar to that of the first station 40*a*.

The first station 40*a* includes a photosensitive drum 1*a*, a charging roller 2*a*, a cleaning unit 3*a*, a developing roller 4*a*, and a developing unit 8*a*, that constitute a combined process cartridge 9*a* that is detachable from the image forming apparatus. Further, the first station 40*a* includes an exposure unit 11*a*, a primary transfer roller 10*a*, a high-voltage developing power supply 21*a*, and a primary transfer high-voltage power supply 22*a*.

The photosensitive drum 1*a* is an exemplary image bearing member and is driven into rotation by a driving source (not illustrated). The charging roller 2*a* charges the photosensitive drum 1*a*. The charging roller 2*a* is disposed in contact with the photosensitive drum 1*a* and is rotated along with the rotation of the photosensitive drum 1*a*. A high-voltage charging power supply 20*a* applies a DC voltage to the charging roller 2*a*. Electric discharge is generated at a micro air gap upstream and downstream of the nip between the surface of the photosensitive drum 1*a* and the charging roller 2*a*, and thus the photosensitive drum 1*a* is charged.

The exposure unit 11*a* causes a rotating polygon mirror to perform scanning with laser light modulated based on image information (image data). In this manner, the exposure unit 11*a* irradiates the photosensitive drum 1*a* with a scanning beam 12*a* to form an electrostatic latent image on the photosensitive drum 1*a*. The developing unit 8*a* includes a developing roller 4*a*, a developer (toner) 5*a*, and a developing blade 7*a*. A high-voltage developing power supply 21*a* applies a DC voltage to the developing roller 4*a*. The developing blade 7*a* charges the toner and applies the toner to the developing roller 4*a*. The developing unit 8*a* forms a toner image on the photosensitive drum 1*a* by developing the electrostatic latent image formed on the photosensitive drum 1*a* with a toner. The cleaning unit 3*a* cleans the surface of the photosensitive drum 1*a* by collecting the toner remaining on the photosensitive drum 1*a*. When the cleaning blade provided in the cleaning unit 3*a* makes contact with the photosensitive drum 1*a*, the toner remaining on the photosensitive drum 1*a* is collected by the cleaning unit 3*a*.

Intermediate Transfer Unit

The intermediate transfer unit is constituted by an intermediate transfer belt 13, a tension roller 14, a secondary transfer opposing roller 15, an auxiliary roller 19, a secondary transfer roller 25, a primary transfer roller 10 (10*a*, 10*b*, 10*c*, and 10*d*), and a cleaning unit 27 for the intermediate transfer belt 13. The tension roller 14, the secondary transfer opposing roller 15, and the auxiliary roller 19 are disposed inside the intermediate transfer belt 13 so as to dispose the intermediate transfer belt 13 in a stretched state. In addition, the tension roller 14, the secondary transfer opposing roller 15, and the auxiliary roller 19 are electrically grounded.

The primary transfer roller 10 presses the photosensitive drum 1*a* via the intermediate transfer belt 13. A primary transfer high-voltage power supply 22*a* applies a DC voltage to the primary transfer roller 10*a*. The secondary transfer opposing roller 15 is driven into rotation by a driving source (not illustrated) to convey the intermediate transfer belt 13. The secondary transfer roller 25 is disposed such that the secondary transfer roller 25 makes contact with the intermediate transfer belt 13 and rotates at a constant speed in the forward direction with respect to the movement direction of the surface of the intermediate transfer belt 13. A secondary transfer high-voltage power supply 26 applies a DC voltage to the secondary transfer roller 25.

The cleaning unit 27 for the intermediate transfer belt 13 cleans the surface of the intermediate transfer belt 13 by collecting the toner remaining on the intermediate transfer belt 13. The cleaning unit 27 is constituted by a cleaning blade and a cleaning container. The cleaning blade collects paper powder generated during conveyance of a sheet P and the toner remaining on the intermediate transfer belt 13. The cleaning container houses the paper powder and the toner collected from the intermediate transfer belt 13. In the present embodiment, the cleaning container is an exemplary collection container to which the toner remaining on the image bearing member (intermediate transfer belt 13) is collected.

Fixing Unit

A fixing unit 50 is constituted by a cylindrical fixing film 51, a nip forming member 52 that holds the fixing film 51, a pressure roller 53, and a heater 54. The pressure roller 53 forms a nip N together with the fixing film 51. The heater 54 is used as a heating source. The nip forming member 52 guides the fixing film 51 from inside and forms, via the fixing film 51, the nip N between the nip forming member 52 and the pressure roller 53. The nip forming member 52 needs to have rigidity, heat resistance, and a thermal insulation property and is formed of a liquid crystal polymer, for example. The pressure roller 53 is driven into rotation by a driving source (a fixing motor 100 in FIG. 2). The fixing film 51 is rotated along with the driving of the pressure roller 53. The heater 54 is held by the nip forming member 52 and makes contact with the inner circumferential surface of the fixing film 51.

Image Forming Operation

Next, an image forming operation of the image forming apparatus illustrated in FIG. 1 is described. The image forming apparatus starts the image forming operation when receiving a print command from an external device in a standby state.

When the image forming operation is started, photosensitive drums 1*a*, 1*b*, 1*c*, and 1*d*, the intermediate transfer belt 13, and the like are driven by a main motor 99 (FIG. 2) and start rotating in the arrow direction at a predetermined process speed. In the first station 40*a*, the photosensitive drum 1*a* is uniformly charged by the charging roller 2*a* and is irradiated with the scanning beam 12*a* from the exposure unit 11*a*, thereby forming an electrostatic latent image based on the image data. In the developing unit 8*a*, the toner 5*a* negatively charged by the developing blade 7*a* is applied to the developing roller 4*a*. A predetermined bias voltage is applied to the developing roller 4*a* by the high-voltage developing power supply 21*a*, and thus the electrostatic latent image formed on the developing roller 4*a* is developed by the toner on the developing roller 4*a*. Thus, a toner image of a first color (Y color in the present embodiment) is formed on the photosensitive drum 1*a*.

In the second to fourth stations 40*b*, 40*c*, and 40*d*, toner images of a second color (M color), a third color (C color), and a fourth color (K color) are formed on the photosensitive drums 1*b*, 1*c*, and 1*d* as in the first station 40*a*. In the second to fourth stations 40*b*, 40*c* and 40*d*, the timing of the exposure by the exposure units 11*b*, 11*c* and 11*d* is controlled in accordance with the distance between the primary transfer positions of the stations. When a high DC opposite the polarity of the toner is applied to the primary transfer rollers 10*a*, 10*b*, 10*c*, and 10*d*, the toner images of respective colors formed on the photosensitive drums 1*a*, 1*b*, 1*c*, and 1*d* are sequentially transferred to the intermediate transfer belt 13. The toner images are transferred to the intermediate transfer belt 13 in an overlapping manner from the photosensitive drums 1*a*, 1*b*, 1*c*, and 1*d*, thereby forming a multi-toner image on the intermediate transfer belt 13.

Thereafter, in accordance with the timing of the formation of the toner image, the sheet P loaded in a sheet cassette 16 is picked up by a sheet feed roller 17 to the conveyance path and conveyed by the conveying roller (not illustrated). Note that the sheet may be referred to as a recording sheet, a recording material, a recording medium, a sheet, a transfer material, or a transfer sheet, for example. After the sheet P is conveyed to a registration roller 18, the sheet P is conveyed by the registration roller 18 to the nip between the intermediate transfer belt 13 and the secondary transfer roller 25 in synchronization with the movement of the toner image on the intermediate transfer belt 13. When a bias voltage opposite the toner is applied to the secondary transfer roller 25 by the secondary transfer high-voltage power supply 26, the toner image borne on the intermediate transfer belt 13 is collectively transferred (secondary transfer) onto the recording material P. In this manner, the intermediate transfer belt 13 functions as an exemplary image bearing member on which an image to be transferred to the sheet that is being conveyed is to be formed.

The toner remaining on the intermediate transfer belt 13 after completion of the secondary transfer is collected by the cleaning unit 27. The recording material P after completion of the secondary transfer is conveyed to the fixing unit 50. The fixing unit 50 performs a fixing process of fixing the toner image to the recording material P. The recording material P after completion of the fixing process is discharged to a discharge sheet tray 30.

<Configuration of Image Forming Apparatus>

Figure 2:
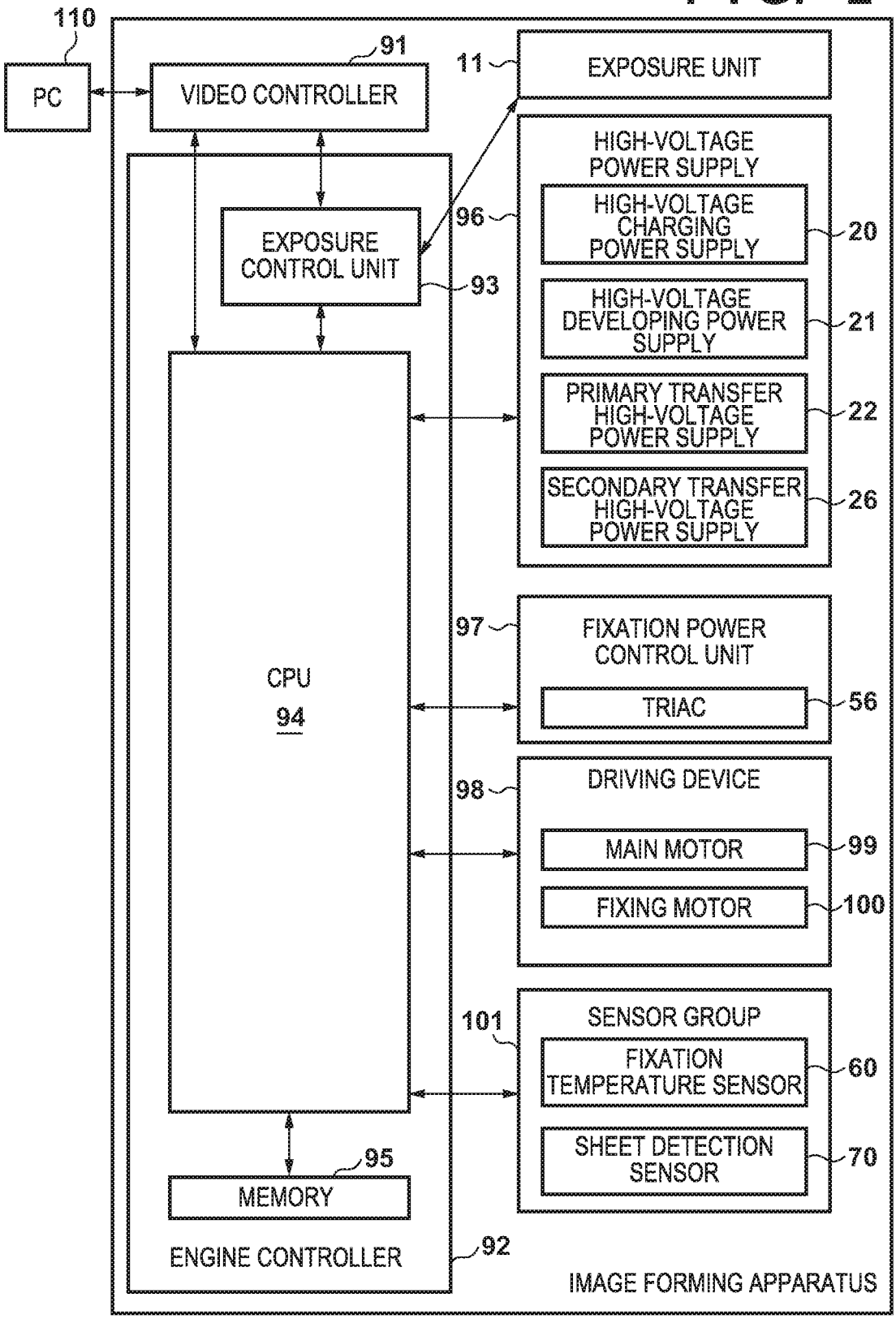
FIG. 2 is a block diagram illustrating an exemplary system configuration of the image forming apparatus.

FIG. 2 is a block diagram illustrating an exemplary configuration of a system of an image forming apparatus. As illustrated in FIG. 2, the image forming apparatus is connected to a PC 110, which is a host computer. Note that the PC 110 may be directly connected to the image forming apparatus or may be connected to the image forming apparatus through a network such as a LAN. The image forming apparatus includes a video controller 91 and an engine controller 92. The engine controller 92 includes an exposure control unit 93, a CPU 94, and a memory 95, and the engine controller 92, by the CPU 94 executing a program preliminarily stored in the memory 95, operates in accordance with the program.

The PC 110 transmits a print command to the image forming apparatus to transfer the image data of a print image to the image forming apparatus. The print command including the image data of the print image is received by the video controller 91 inside the image forming apparatus. The video controller 91 converts the image data received from the PC 110 into exposure data and transfers the exposure data to the exposure control unit 93 in the engine controller 92. Under control of the CPU 94, the exposure control unit 93 controls the exposure performed by an exposure unit 11 on the basis of the exposure data. The CPU 94 starts executing an image forming sequence when receiving a print command from the video controller 91.

A high-voltage power supply 96 is constituted by a high-voltage charging power supply 20, the high-voltage developing power supply 21, the primary transfer high-voltage power supply 22, and the secondary transfer high-voltage power supply 26. A fixation power control unit 97 controls the power supplied to the fixing unit 50 by using a triac 56. A driving device 98 is constituted by various motors such as the main motor 99 and the fixing motor 100.

A sensor group 101 is constituted by various sensors and includes a fixation temperature sensor 60 and a sheet detection sensor 70. The fixation temperature sensor 60 is a sensor that detects the temperature of the fixing unit 50. The sheet detection sensor 70 (sheet detection unit) detects the sheet conveyed on the conveyance path. The detection results of the fixation temperature sensor 60 and the sheet detection sensor 70 are transmitted to the CPU 94.

The CPU 94 acquires the detection result output from the sensor group 101 and controls the image forming process on the basis of the detection result. Specifically, the CPU 94 controls the above-mentioned processes of the exposure, the development, the transfer, and the fixing by controlling the exposure unit 11, the high-voltage power supply 96, the fixation power control unit 97, and the driving device 98.

<Configuration and Arrangement of Sheet Detection Sensor>

Figure 3B:
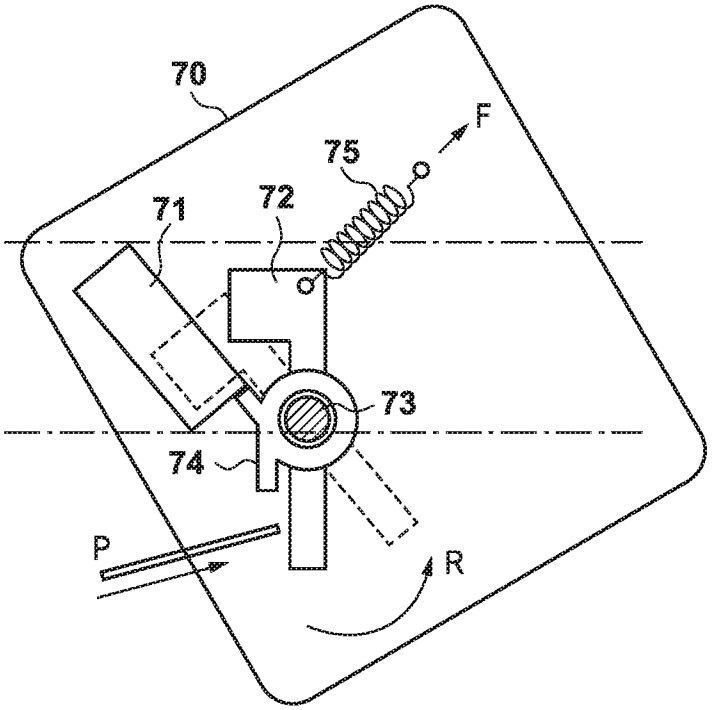
FIGS. 3A and 3B are front and side views illustrating a schematic exemplary configuration of a sheet detection sensor.
Figure 3A:
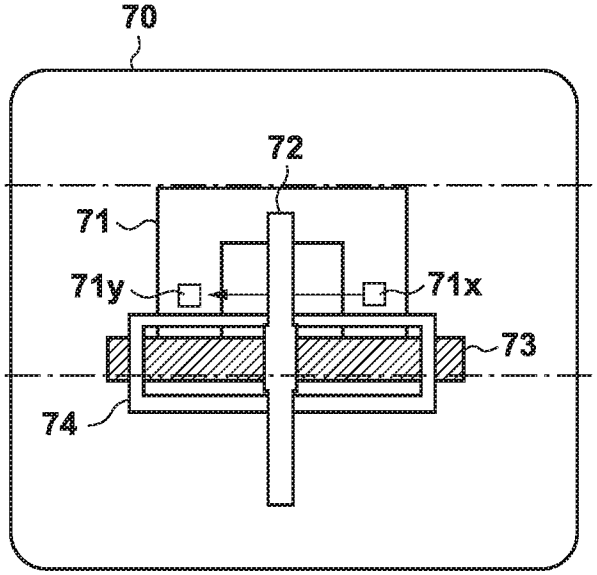

The configuration and arrangement of the sheet detection sensor 70 are described with reference to FIGS. 3A, 3B, 4A, and 4B. FIG. 3A is a front view illustrating an exemplary configuration of the sheet detection sensor 70, and FIG. 3B is a side view illustrating an exemplary configuration of the sheet detection sensor 70. The sheet detection sensor 70 is constituted by a photo-interrupter 71, a detection flag 72, a flag shaft 73, a flag bearing 74, and a tension spring 75.

The photo-interrupter 71 includes a light emitting unit 71*x* and a light receiving unit 71*y* provided to a U-shaped body. The photo-interrupter 71 is, for example, a transmissive photosensor in which the light emitting unit 71*x* and the light receiving unit 71*y* are constituted by an infrared light emitting diode and a silicon phototransistor, respectively, and the light emitting unit 71*x* and the light receiving unit 71*y* are disposed facing each other. The cylindrical flag shaft 73 is integrated with the detection flag 72 and passing through the flag bearing 74, and the position of the flag bearing 74 is fixed. The detection flag 72 is capable of rotating about the flag shaft 73 as the axis.

The sheet detection sensor 70 is disposed at a midpoint in the conveyance path of the sheet P. The detection flag 72 is preliminarily pulled by the tension spring 75 in such a manner as to remain at the position indicated by the solid line in FIG. 3B. As illustrated in FIG. 3B, when the sheet P conveyed on the conveyance path collides with the detection flag 72, the detection flag 72 rotates in an arrow direction R. When rotated and moved to the position indicated by the dashed line in FIG. 3B, the detection flag 72 enters between the light emitting unit 71*x* and the light receiving unit 71*y* and blocks light that is output from the light emitting unit 71*x* and is received by the light receiving unit 71*y*.

The sheet detection sensor 70 outputs a result of light reception at light receiving unit 71*y* as a detection result of the sheet. On the basis of the output from the sheet detection sensor 70, the CPU 94 determines the presence or absence of the sheet being conveyed on the conveyance path. If light is received by the light receiving unit 71*y*, the CPU 94 determines that no sheet is detected (absence of the sheet). On the other hand, if no light is received by the light receiving unit 71*y* (light is blocked) on the basis of the output from the sheet detection sensor 70, the CPU 94 determines that the sheet is detected (presence of the sheet).

Figure 4A:
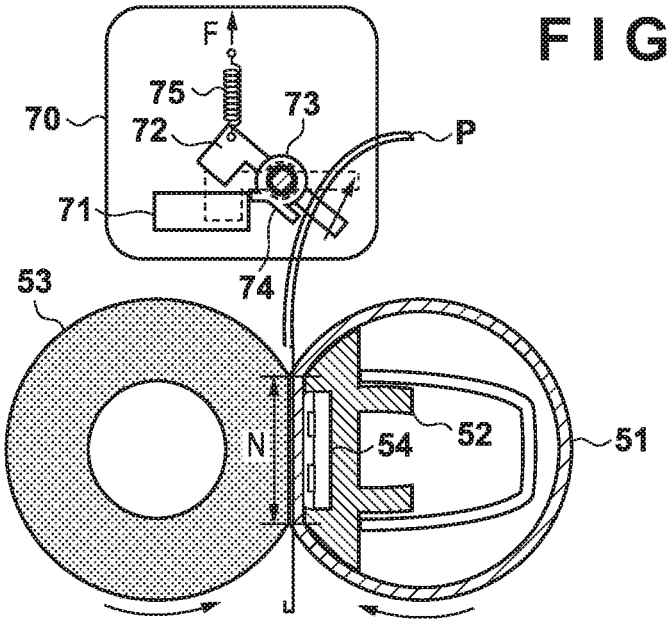
FIGS. 4A and 4B are diagrams illustrating an exemplary arrangement of a sheet detection sensor.
Figure 4B:
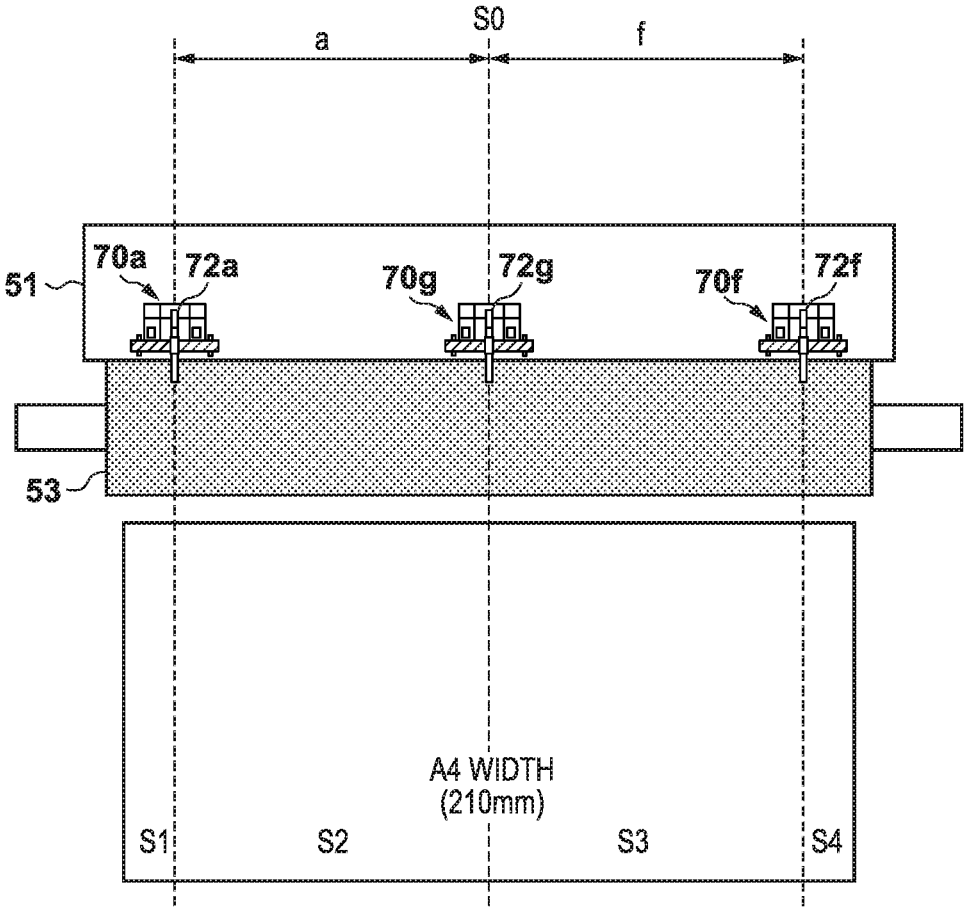

FIG. 4A illustrates an arrangement of the sheet detection sensor 70 in the sheet conveyance direction, and FIG. 4B illustrates an arrangement of the sheet detection sensor 70 in the sheet width direction, which is a direction orthogonal to the sheet conveyance direction. As illustrated in FIG. 4A, the sheet detection sensor 70 is disposed downstream of the fixing unit 50 in the sheet conveyance direction. The sheet detection sensor 70 is disposed such that the detection flag 72 interferes with the conveyance path of the sheet P.

As illustrated in FIG. 4B, a plurality of sheet detection sensors 70 are disposed along the sheet width direction. In the present embodiment, the sheet detection sensors 70 (70*a*, 70*g*, and 70*f*) are disposed at three positions in total in the sheet width direction, namely, positions near both ends of the conveyance path and a center position S0 of the conveyance path. A distance a between the center position S0 and a detection flag 72*a* of the sheet detection sensor 70*a* and a distance f between the center position S0 and a detection flag 72*f* of the sheet detection sensor 70*f* are each 100 mm, for example. In the present embodiment, the region in the sheet width direction is divided into four sheet regions, and the sheet regions are defined as S1 to S4.

<Image Forming Control>

In the present embodiment, the image forming apparatus performs a sheet determination process and an image determination process after the start of the image forming operation. The sheet determination process is a process of determining the presence or absence of the sheet being conveyed in each of the plurality of regions (sheet regions S1 to S4) sectioned in the sheet width direction by using the plurality of sheet detection sensors 70 as described above. The image determination process is a process of determining the presence or absence of an image to be formed in each of the plurality of regions (sheet regions S1 to S4) sectioned in the sheet width direction on the basis of the input image data. The image forming apparatus determines whether or not the image is to be formed with a deviation from the sheet on the basis of the results of the sheet determination process and the image determination process and, in accordance with the determination result, controls whether or not to continue the image forming operation.

Figure 5:
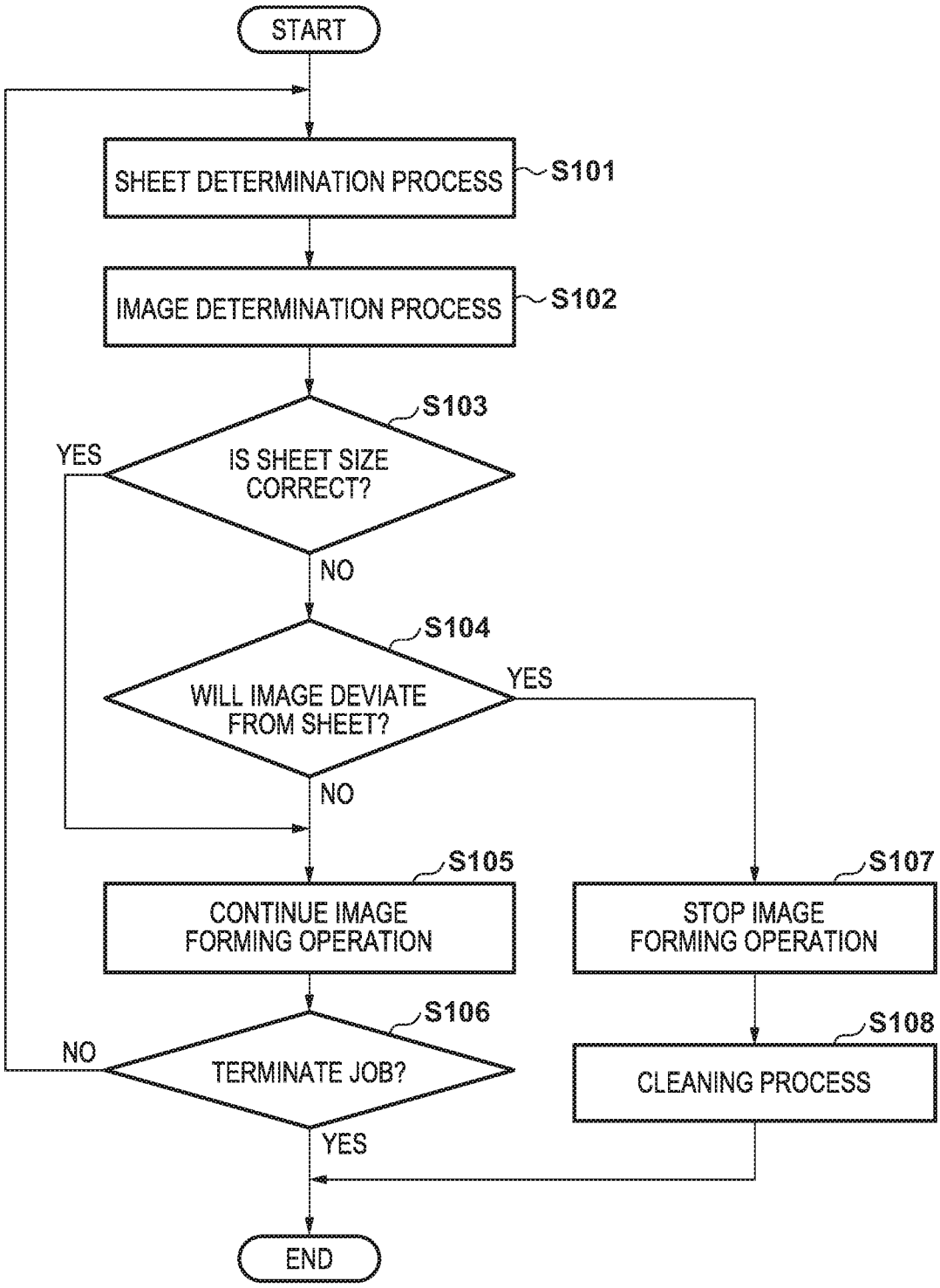
FIG. 5 is a flowchart illustrating a control procedure for an image forming operation.

The above-described control is described in more detail with reference to FIGS. 5 to 11. FIG. 5 is a flowchart illustrating a control procedure for the image forming operation according to the present embodiment. Each step in FIG. 5 is achieved by the CPU 94 reading and executing the program stored in the memory 95, for example.

After the image forming operation is started, at S101, the CPU 94 performs a sheet determination process of determining the presence or absence of the sheet being conveyed in each of the plurality of sheet regions S1 to S4. If the sheet P conveyed on the conveyance path passes through the fixing unit 50 and reaches the sheet detection sensor 70, the sheet determination process can be executed. In the present embodiment, the presence or absence of the sheet in each of the sheet regions S1 to S4 illustrated in FIG. 4B is determined. Further, at S102, the CPU 94 performs the image determination process of determining the presence or absence of an image in each of the plurality of sheet regions S1 to S4.

Next, at S103, the CPU 94 determines whether or not the size of the sheet actually conveyed from the sheet cassette 16 is correct in light of the sheet size designated (designated by the user) in the image forming job. If the CPU 94 determines that the sheet size is correct, the CPU 94 advances the process to S105 and continues the image forming operation. In this case, at S106, the CPU 94 determines whether or not to terminate the execution of the image forming job. If the process according to the image forming job is completed, the CPU 94 terminates the process, and otherwise, the CPU 94 returns the process to S101 and repeats the above-mentioned process until the process according to the image forming job is completed.

On the other hand, if the CPU 94 determines that the sheet size is incorrect at S103, the CPU 94 advances the process to S104. At S104, on the basis of the determination results at S101 and S102, the CPU 94 determines whether or not an image to be formed on the sheet being conveyed will be formed with a deviation from the sheet. If it is determined that the image is to be formed without a deviation from the sheet, the CPU 94 advances the process to S105 and continues the image forming operation. If it is determined that the image is to be formed with a deviation from the sheet, the CPU 94 advances the process to S107. At S107, the CPU 94 stops the image forming operation and advances the process to S108. At S108, the CPU 94 executes a cleaning process of cleaning not only the photosensitive drum 1 and the intermediate transfer belt 13 but also the secondary transfer roller on which the toner has adhered, and terminates the process.

Specific examples of S101 to S104 are described below.

S101: Sheet Determination Process

Figure 6A:
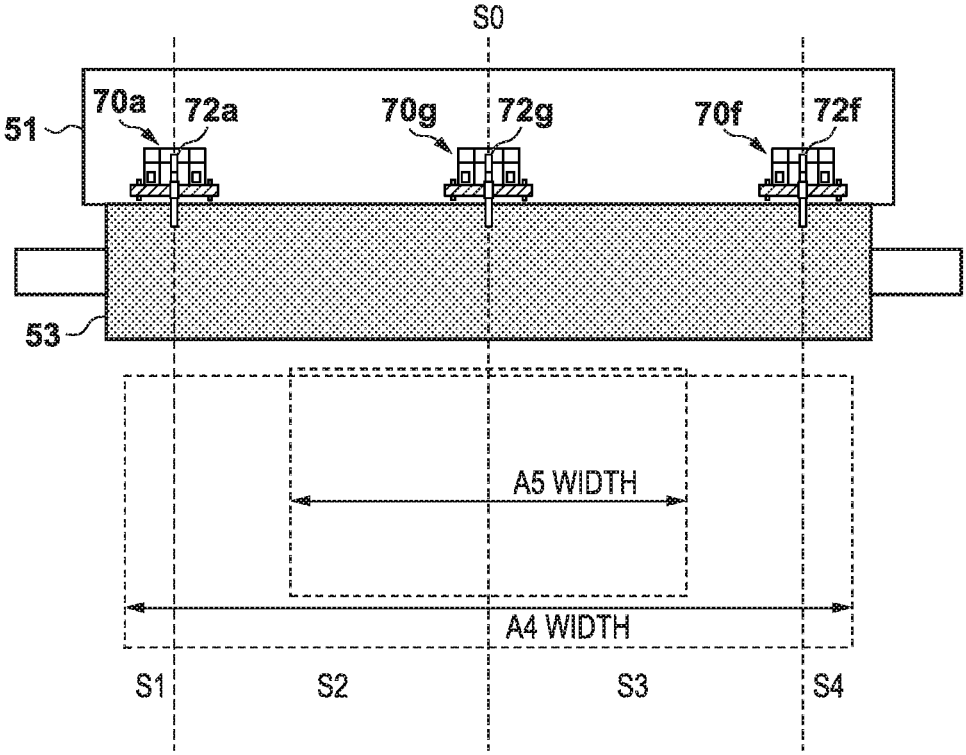

FIGS. 6A to 6C illustrate an exemplary sheet determination process. FIG. 6A illustrates a positional relationship between the sheet and the sheet detection sensor 70 in the case where a sheet with the A5 width (148 mm) and a sheet with the A4 width (210 mm) are conveyed. FIG. 6B illustrates results of the sheet determination process in the case where a sheet with the A5 width is conveyed, and FIG. 6C illustrates results of the sheet determination process in the case where a sheet with the A4 width is conveyed. FIGS. 6B and 6C illustrate the sheet detection sensors 70 located on both ends of each sheet region and detection results thereof, processing results of the outputs of the sheet detection sensors 70 in the sheet regions, and determination results of the presence or absence of the sheet based on the processing results.

As illustrated in FIGS. 6A and 6B, the sheet with the A5 width makes contact with the detection flag 72*g* of the sheet detection sensor 70*g* disposed at the center position S0, and accordingly the sheet is detected by the sheet detection sensor 70*g*, and "1" is output as the detection result from the sheet detection sensor 70*g*. On the other hand, no sheet is detected by the sheet detection sensors 70*a* and 70*f*, and accordingly "0" is output from the sheet detection sensors 70*a* and 70*f* as the detection result. The output of each sheet detection sensor 70 is stored in the memory 95 by the CPU 94.

The CPU 94 processes the output of each sheet detection sensor 70 stored in the memory 95. In the present example, the product of the outputs of the sheet detection sensors of both ends is generated as the processing result for each sheet region. If the outputs of two adjacent sheet detection sensors disposed at both ends of each sheet region are each "1", it is considered that the sheet is conveyed (the sheet is present) in the sheet region. Thus, in the present example, the determination of the presence or absence of the sheet in each sheet region is achieved by determining the product of the outputs of the two sheet detection sensors disposed at both ends of each sheet region. Note that in the sheet regions S1 and S4, the sheet detection sensor 70 is disposed only at one end of the sheet region, and accordingly "0" is always generated as the processing result.

For each sheet region, the CPU 94 performs a determination process in which it is determined that the sheet is present in the sheet region in a case where the processing result is "1", whereas it is determined that no sheet is present in the sheet region in a case where the processing result is "0". According to the determination result in FIG. 6B, it is determined that no sheet is present in any of the sheet regions S1 to S4.

On the other hand, as illustrated in FIGS. 6A and 6C, the sheet with the A4 width makes contact with the detection flags 72*a*, 72*g*, and 72*f* of all of the sheet detection sensors 70*a*, 70*g*, and 70*f*. As a result, "1" is output as the detection result from all of the sheet detection sensors 70*a*, 70*g*, and 70*f*. On the basis of this detection result, it is determined that the sheet is present in the sheet regions S2 and S3 through the above-mentioned determination process.

In the present embodiment, the sheet detection sensor 70 is disposed downstream of the fixing unit 50 (immediately after the fixing unit 50) in the sheet conveyance direction. Thus, the presence or absence of the sheet in each sheet region can be determined using the sheet detection sensor 70 immediately after the sheet being conveyed on the conveyance path passes through the fixing unit 50.

S102: Image Determination Process

As illustrated in the exemplary system configuration of FIG. 2, a print command (image forming job) transmitted from the PC 110 is transferred to the video controller 91. In this print command, the size of the sheet used for image formation is designated. Input image data included in the print command is converted to exposure data and transferred to the exposure control unit 93 and transferred also to the CPU 94. The CPU 94 performs the image determination process by loading the exposure data into an image memory (not illustrated) and determining whether or not a pixel to be formed is present in each sheet region on the basis of the exposure data.

Figures 7A, 7B:
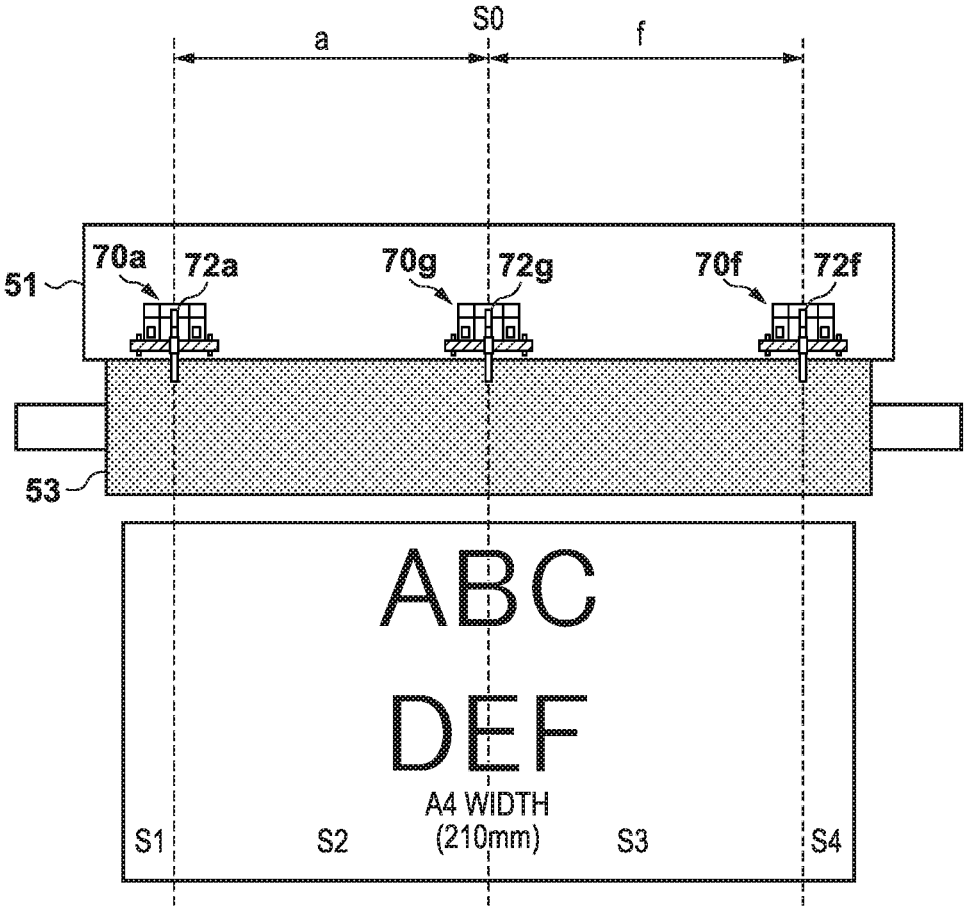
FIGS. 7A and 7B are diagrams illustrating an exemplary image determination process.

FIGS. 7A and 7B illustrate an exemplary image determination process. FIG. 7A illustrates an example in which an image "ABCDEF" with the A4 width is formed. The CPU 94 determines the presence or absence of an image to be formed in each of the sheet regions S1 to S4 by determining the position where the pixel to be formed is present on the basis of the input image data (exposure data). As illustrated in FIG. 7B, for each sheet region, the CPU 94 generates "1" as the determination result in a case where the CPU 94 determines that an image is present, whereas the CPU 94 generates "0" as the determination result in a case where the CPU 94 determines that no image is present. In the example of FIG. 7B, the obtained determination result indicates that the image to be formed is present in the sheet regions S2 and S3.

S103: Process of Determining Sheet Size

The determination process of S103 is a process of determining whether or not the sheet size designated by a user using the PC 110 and the size of the sheet actually conveyed from the sheet cassette 16 match. Specifically, the CPU 94 stores the sheet size designated by the print command in the memory 95. The CPU 94 determines that the sheet size is correct in a case where the sheet size stored in the memory 95 matches the result of the sheet determination process of S101, whereas the CPU 94 determines that the sheet size is incorrect in a case where the sheet size stored in the memory 95 does not match the result of the sheet determination process of S101.

For example, in the case where the sheet size of the A4 width is designated, it is predicted that (S1, S2, S3, S4)=(0, 1, 1, 0) is obtained as the result of the sheet determination process. The CPU 94 determines that the sheet size is correct if the result of such a prediction and the result of the sheet determination process are identical to each other. In the present embodiment, the CPU 94 performs a control of continuing the image forming operation in a case where it is determined that the sheet size is correct as described above. On the other hand, in a case where it is determined that the sheet size is incorrect, the CPU 94 performs a control of stopping the image forming operation in accordance with the result of the determination process of S104.

S104: Process of Determining Image Deviation

In the determination process of S104, whether or not the image to be formed deviates from the sheet is determined by identifying the sheet region where it is determined that no sheet is present in the sheet determination process of S101 and that an image is present in the image determination process of S102. This determination can be achieved, for example, by determining the difference between the determination result of the sheet determination process and the determination result of the image determination process.

Figure 8A:
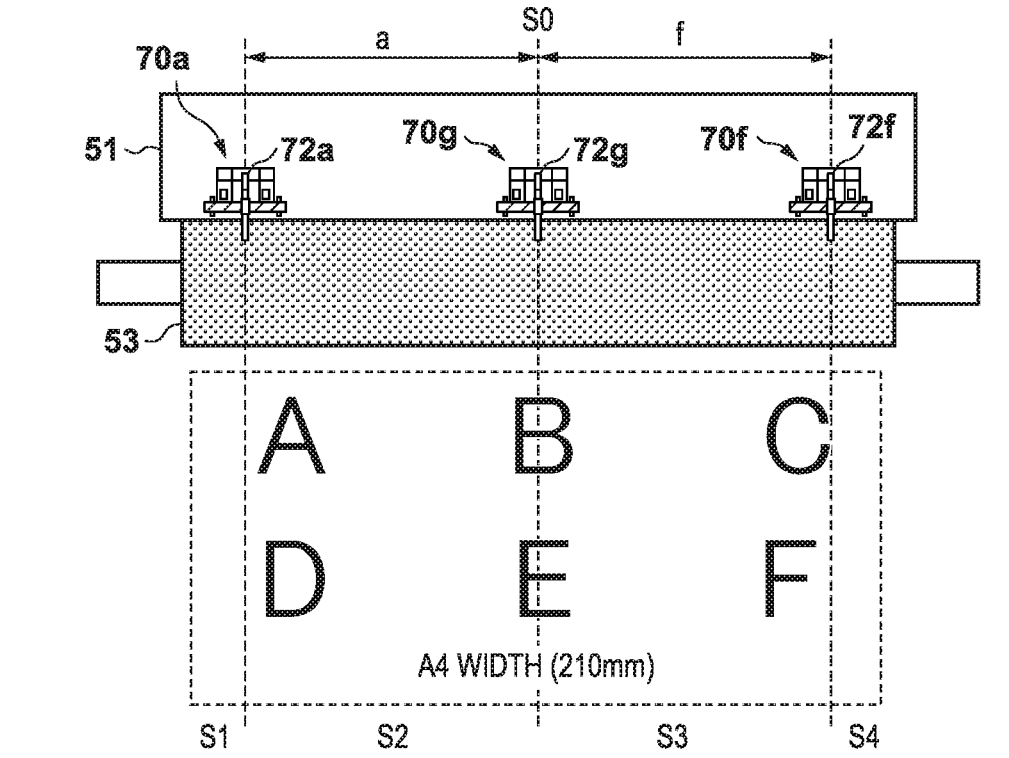
FIGS. 8A and 8B illustrate an exemplary control of the image forming operation.
Figure 8B:
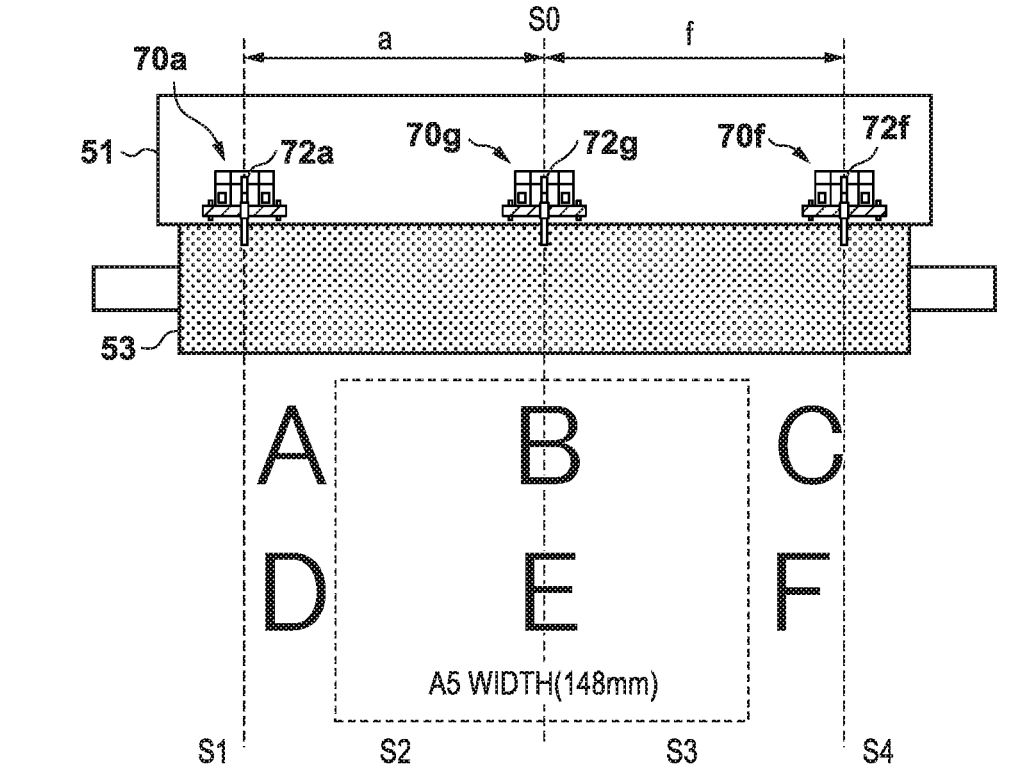

FIG. 8A and FIG. 8B illustrate the determination process of S104 and an exemplary control of the image forming operation on the basis of the determination result of the determination process of S104. FIG. 8A corresponds to a case where a sheet with the A4 width is conveyed from the sheet cassette 16, and FIG. 8B corresponds to a case where a sheet with the A5 width is conveyed from the sheet cassette 16. In the examples of FIG. 8A and FIG. 8B, the difference between the determination results is determined by subtracting the determination result ("1" or "0") of the image determination process from the determination result ("1" or "0") of the sheet determination process. As a result of this process, the sheet region where the difference is "4" can be identified as the sheet region where it is determined that no sheet is present but an image is present (i.e., a region where an image deviated from the sheet is to be formed).

In the case where the above-described difference is not "−1" in all of the sheet regions S1 to S4 as illustrated in the example of FIG. 8A, the CPU 94 determines that the image to be formed does not deviate from the sheet and continues the image forming operation. On the other hand, in the case where the above-described difference is "4" in any of the sheet regions S1 to S4 as illustrated in the example of FIG. 8B, the CPU 94 determines that the image to be formed deviates from the sheet. In this manner, in the determination process of S104, in a case where, among the plurality of sheet regions S1 to S4, there is a region where it is determined that no conveyed sheet is present and that an image to be formed is present, the CPU 94 determines that the image is to be formed with a deviation from the sheet. In accordance with this determination result, the CPU 94 stops the image forming operation.

S108: Cleaning Process

In the case where the image forming operation is stopped in the above-mentioned manner (S107), the CPU 94 performs the cleaning process of S108. At the time point when the processes of S101 to S104 and S107 are performed, the sheet P being conveyed has already passed through the fixing unit 50. This sheet P is discharged directly to the discharge sheet tray 30. Specifically, after discharging the sheet P, the CPU 94 stops the image forming operation and performs the cleaning process. The CPU 94 operates such that the toner remaining on the photosensitive drum 1 is collected to a corresponding cleaning unit 3 and the toner remaining on the intermediate transfer belt 13 is collected to the cleaning unit 27. Also, by applying a reverse bias voltage to the secondary transfer roller 25, the CPU 94 reverse-transfers the toner adhered to the secondary transfer roller 25 to the intermediate transfer belt 13 such that the toner is collected to the cleaning unit 27.

Comparison with Comparative Example

Figure 9A:
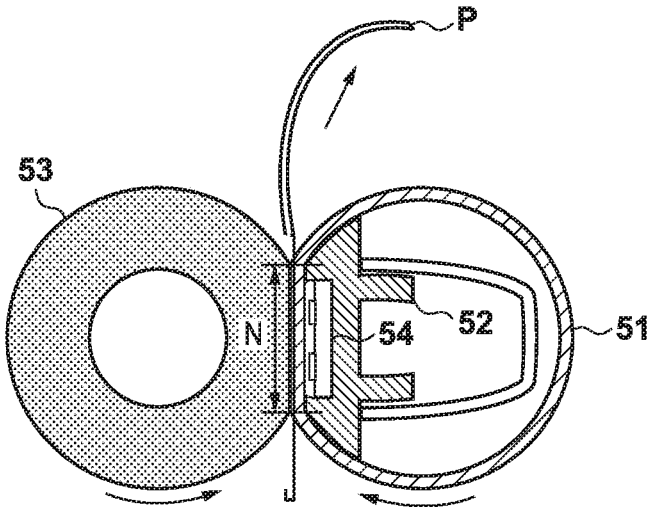
FIGS. 9A and 9B are diagrams illustrating an exemplary configuration of an image forming apparatus of a comparative example.
Figure 9B:
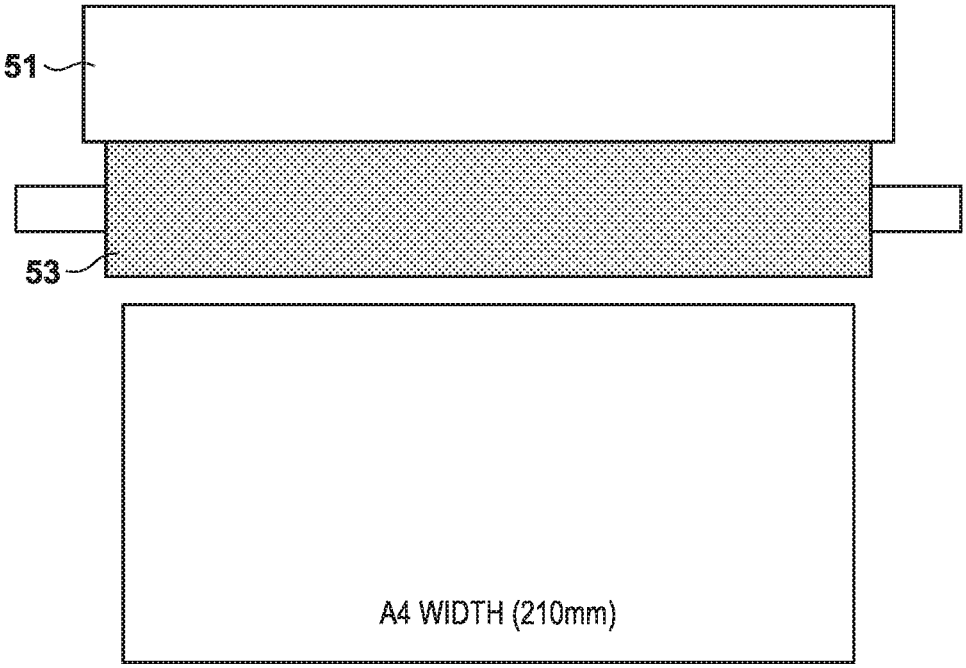
Figure 10:
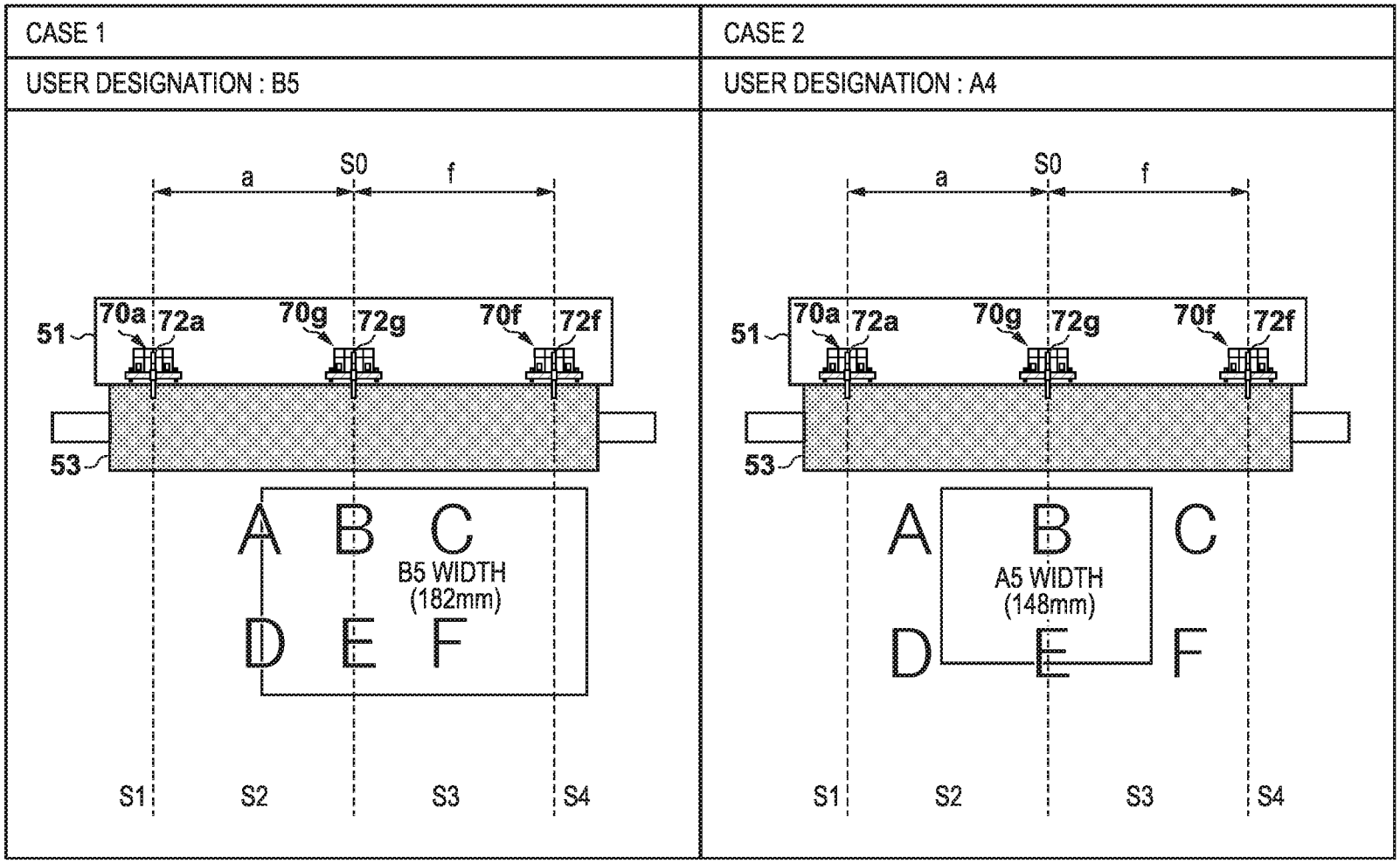
FIG. 10 is a diagram illustrating an exemplary condition for comparison with the comparative example.

Now, the control examples and advantages of the present embodiment are described with a comparative example in which the image forming operation is controlled without using the sheet detection sensor 70 as in an exemplary configuration illustrated in FIGS. 9A and 9B. FIGS. 9A and 9B illustrate a comparative example for the exemplary configuration of Embodiment 1 illustrated in FIGS. 4A and 4B, and the sheet detection sensor 70 is not provided in this comparative example. FIG. 10 illustrates exemplary conditions for comparison with the comparative example. Case 1 is a case in which the user sets a B5 sheet on one side in the sheet width direction in the sheet cassette 16. Case 2 is a case in which the user has designated the A4 size as the sheet size but an A5 sheet has been set in the sheet cassette 16.

FIG. 11 illustrates controls of the image forming operation in the present embodiment and the comparative example under the conditions illustrated in FIG. 10. In the comparative example, the image forming operation is continued without being stopped in both Case 1 and Case 2. Through the continued image forming operation, fouling of the secondary transfer roller 25 is continually generated by the toner transferred with a deviation from the sheet, and the toner deviated from the sheet and remaining on the intermediate transfer belt 13 is continually collected to the cleaning unit 27. In this case, overflow of toner in the cleaning unit 27 (cleaning container) may occur.

On the other hand, in the present embodiment, in both Case 1 and Case 2, there is a sheet region where the difference between the determination result of the sheet determination process and the determination result of the image determination process is "−1". Accordingly, the CPU 94 determines that the image deviates from the sheet, and stops the image forming operation. Thus, it is possible to minimize the amount of toner collected to the cleaning container (cleaning unit), while minimizing the fouling of the secondary transfer roller 25 by executing the cleaning process (S108).

Note that in the present embodiment, as the sheet detection sensor 70, a distance sensor or a temperature sensor may be used in place of a sensor composed of a combination of a photo-interrupter and a detection flag. In the case of a distance sensor, the output of the distance sensor varies depending on the presence or absence of the sheet at a measurement target position of the distance sensor. The presence or absence of the sheet at the measurement target position of the distance sensor can be determined based on the difference in output. In addition, in the case of a temperature sensor, when the sheet having passed through the fixing unit 50 passes through the measurement target position of the temperature sensor, a higher temperature is detected than in the case where no sheet is present at the measurement target position. The presence or absence of the sheet at the measurement target position of the temperature sensor can be determined based on the temperature difference detected by the temperature sensor.

As described above, in the present embodiment, the image forming apparatus includes a plurality of the sheet detection sensors 70 that are provided at different positions along the sheet width direction and are configured to detect the sheet being conveyed on the conveyance path. The CPU 94 determines the presence or absence of the sheet being conveyed in each of the plurality of sheet regions sectioned in the sheet width direction by using the plurality of sheet detection sensors 70 and determines the presence or absence of the image to be formed in each of the plurality of sheet regions on the basis of the input image data. Further, on the basis of these determination results, the CPU 94 determines whether or not the image to be formed on the sheet being conveyed will be formed with a deviation from the sheet, and in accordance with this determination result, the CPU 94 controls the image forming operation. Specifically, the CPU 94 performs a control of continuing or stopping the image forming operation. Thus, it is possible to reduce the fouling of the secondary transfer roller 25 due to the image formed with a deviation from the sheet in the sheet width direction. In other words, it is possible to prevent the occurrence of fouling with the toner inside the image forming apparatus due to the image transferring with a deviation from the sheet.

Embodiment 2

In Embodiment 2, an example is described in which the number of the sheet detection sensors is increased and the number of sheet regions used in the sheet determination process and the image determination process is increased. Specifically, the number of sheet detection sensors is increased to 7, and the number of sheet regions used in the sheet determination process and the image determination process is increased to 8. This increases the distinguishable sheet sizes and increases the cases in which the image forming operation is continued. In the following, descriptions of parts common to Embodiment 1 will be omitted.

Figure 12:
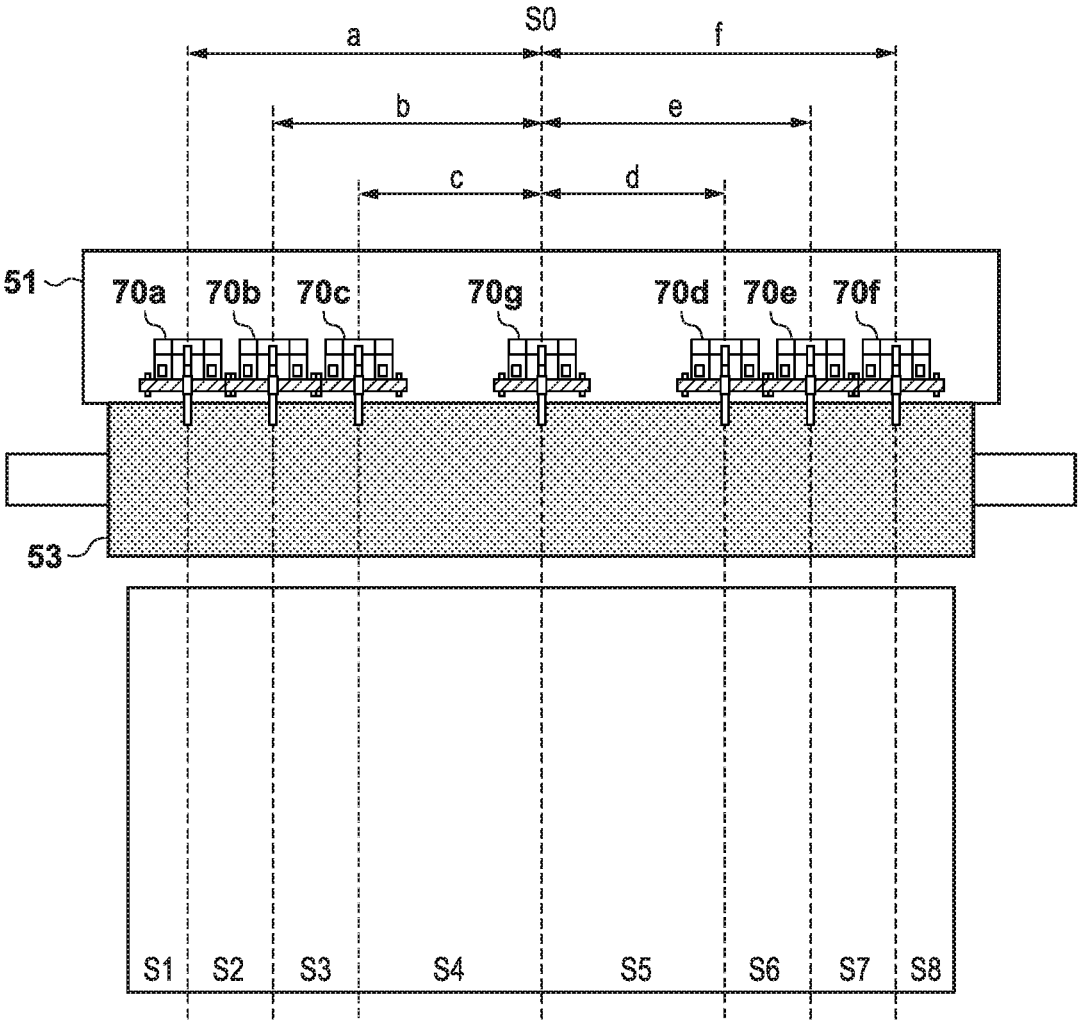
FIG. 12 is a diagram illustrating an exemplary arrangement of a sheet detection sensor (Embodiment 2).

FIG. 12 is a diagram illustrating an exemplary arrangement of the sheet detection sensors 70 according to the present embodiment. Note that the configuration of each sheet detection sensors 70 is the same as in Embodiment 1. In the present embodiment, seven sheet detection sensors 70 (70*a* to 70*g*) are disposed at different positions in the sheet width direction. The distances a to f to the detection flag 72 of each of the sheet detection sensors 70 from the center position S0 in the sheet width direction are defined as a=f=100 mm, b=e=85 mm, and c=d=70 mm, for example. In addition, the region in the sheet width direction is divided into eight sheet regions by the seven sheet detection sensors 70, and the sheet regions are defined as S1 to S8.

In the present embodiment, the image forming operation is controlled through the procedure illustrated in FIG. 5 as in Embodiment 1. In the following, the control examples and advantages of the present embodiment are described in comparison with Embodiment 1. FIGS. 13A and 13B are a diagram illustrating exemplary conditions for comparison with Embodiment 1 and comparison results. Case 3 illustrated in FIG. 13A is a case in which the user sets a B5 sheet on one side in the sheet width direction in the sheet cassette 16. Case 4 illustrated in FIG. 13B is a case in which the user has designated the A4 size as the sheet size, but an A5 sheet has been set in the sheet cassette 16. Note that, in both Case 3 and Case 4, it is assumed that the image falls within the sheet being conveyed (the image is formed without a deviation from the sheet).

According to the comparison results illustrated in FIGS. 13A and 13B, there is no sheet region where the difference between the determination result of the sheet determination process and the determination result of the image determination process is "−1" in both Case 3 and Case 4 in the present embodiment. Accordingly, the CPU 94 determines that the image does not deviate from the sheet and continues the image forming operation. In this case, the fouling of the secondary transfer roller 25 does not occur since the toner is not transferred to the secondary transfer roller 25 with a deviation from the sheet.

On the other hand, in Embodiment 1, there is a sheet region where the difference between the determination result of the sheet determination process and the determination result of the image determination process is "−1" in both Case 3 and Case 4. Accordingly, the CPU 94 determines that the image deviates from the sheet, and stops the image forming operation. Thereafter, the CPU 94 executes the cleaning process (S108) on the secondary transfer roller 25 and the intermediate transfer belt 13.

In both Case 3 and Case 4 assumed above, the image is formed within the sheet, and it is therefore not necessary to stop the image forming operation as in Embodiment 1. On the other hand, as in Embodiment 2, by increasing the number of sheet detection sensors and increasing the number of sheet regions used in the sheet determination process and the image determination process, it is possible to improve the accuracy of the determination whether the image deviates from the sheet. As a result, it is possible to avoid unnecessary stop of the image forming operation.

According to the present embodiment, it is possible to accurately determine whether or not the image deviates from the sheet for sheet types which are frequently used (A4 size, A5 size, B5 size and the like), for example. Thus, unnecessary stop of the image forming operation can be avoided, and the frequency of the cleaning operation associated with the stop of the image forming operation can be reduced.

Here, when the cleaning process of collecting, to the cleaning container, the toner remaining on the image bearing member such as the photosensitive drum and the intermediate transfer belt is frequently performed, the cleaning container is filled to capacity earlier than expected, and toner overflown from the container may cause fouling inside the apparatus. In contrast, according to the present embodiment, it is possible to reduce the frequency of performing the cleaning process while preventing the fouling of the secondary transfer roller 25 with the toner so as to reduce the amount of the toner collected to the cleaning container in the cleaning process. In other words, it is possible to reduce the possibility of the fouling with the toner inside the image forming apparatus due to the toner overflown from the cleaning container.

Embodiment 3

In Embodiment 3, an example is described in which, when an image is formed with a deviation from the sheet, the amount of toner transferred with a deviation is predicted, and the image forming operation is continued unless such an amount of toner exceeds a predetermined limit. Specifically, the integrated value of the amount of toner that deviates from the sheet is managed as a management value, and whether or not to continue the image forming operation is controlled in accordance with the result of comparison between the management value and a threshold defining the limit. In the following, descriptions of parts common to Embodiments 1 and 2 will be omitted.

<Management Values Tadd1 and Tadd2>

In the present embodiment, two management values (a first management value Tadd1 and a second management value Tadd2) are used to manage the amount of toner that is transferred with a deviation from the sheet.

The first management value Tadd1 is a management value for determining the amount of toner adhered to the secondary transfer roller 25. When an image is transferred from the intermediate transfer belt 13 to a sheet, the toner forming the image portion deviated from the sheet adheres to the surface of the secondary transfer roller 25. The amount of toner that can continually adhere to the surface of the secondary transfer roller 25 is limited. When the amount of toner deviated from the sheet reaches an amount exceeding the limit, the toner that cannot continually adhere to the surface of the secondary transfer roller 25 drops inside the image forming apparatus, and fouling of the image forming apparatus with the toner may occur. Also, the toner that cannot continually adhere to the surface of the secondary transfer roller 25 may be transferred to the back surface of the sheet during the execution of the next image forming job, and consequently fouling on the back of the sheet may occur. In view of this, in the present embodiment, the first management value Tadd1 is prepared for the purpose of determining the amount of toner that is adhered to the secondary transfer roller 25.

The second management value Tadd2 is a management value for determining the amount of the toner that is collected to the cleaning container (cleaning unit 27) for the intermediate transfer belt 13. The toner transferred with a deviation from the sheet not only adheres to the secondary transfer roller 25, but also moves onto the intermediate transfer belt 13. The toner transferred onto the intermediate transfer belt 13 is collected by the cleaning blade of the cleaning unit 27 and housed in the cleaning container. The amount of toner that can be housed in the cleaning container is limited. In view of this, in the present embodiment, the second management value Tadd2 is prepared for the purpose of managing the amount of the toner that is collected to the cleaning container for the intermediate transfer belt 13.

In the present embodiment, instead of a value obtained by directly counting the amount of toner, the number of times of the deviation of the image from the sheet (the number of sheets with image deviation) is used as the first and second management values Tadd1 and Tadd2.

Specifically, the CPU 94 counts the number of sheets on which images have been formed with a deviation during the execution of one image forming job and manages the number as the first management value Tadd1. The Tadd1 is reset to zero each time the cleaning process of the secondary transfer roller 25 is performed. In addition, the CPU 94 counts the number of sheets on which images have been formed with a deviation in a period until the cleaning container is replaced and manages the number as Tadd2. The Tadd2 is reset to zero each time the cleaning container is replaced with a new container.

<Thresholds Th1 and Th2>

In the present embodiment, a threshold Th1 for comparison with the first management value Tadd1 and a threshold Th2 for comparison with the second management value Tadd2 are further prepared.

The threshold Th1 is a value that can be set by a preliminarily conducted experiment. Specifically, the image is transferred with a deviation from the sheet and then the number of sheets that have been printed at the time when the toner drops from the secondary transfer roller 25 inside the apparatus is confirmed. In addition, whether fouling on the back of the sheet occurs during subsequent printing is confirmed.

For example, assume a case of an output of a typical user in which an image of the A4 size on which a toner of 0.01 $mg/cm^2$ for each color, i.e., a toner of 0.04 $mg/cm^2$ in total is put is continuously printed on sheets with a shorter sheet width relative to the image. In addition, assume that the sheet size is 148 mm in width and 297 mm in length. In one example experiment, it was confirmed that the toner drops from the secondary transfer roller 25 inside the apparatus during printing on the seventeenth sheet. In addition, it was confirmed that fouling on the back of the sheet occurs when continuous printing is terminated and then printing is restarted using an A4 sheet. On the other hand, neither fouling with the toner inside the apparatus nor fouling on the back of the sheet occurred during printing on the tenth sheet. In this case, as an example, the threshold Th1=10 (sheets) can be set.

The threshold Th2 is a value that can be calculated by computation. For example, assume a case where the amount (capacity) of toner that can be housed in the cleaning container (cleaning unit 27) for the intermediate transfer belt 13 is 30 g, and 5 g of the 30 g is the amount (i.e., the limit) of the collected toner that has been transferred with a deviation from the sheet. In this case, the number of sheets that have been printed at the time when the amount of the collected toner reaches the limit, 5 g, is confirmed.

In the case where a toner image of 0.01 mg/cm$^2$ for each color, i.e., 0.04 mg/cm$^2$ in total, is formed on the entire surface of the sheet in a sheet setting of the A4 size, the amount of toner used per sheet is approximately 23 mg. Under this condition, if a sheet with the A4 length is conveyed based on the A5 width, approximately 17 mg of the toner is transferred to the sheet while approximately 6 mg of the toner deviates from the sheet and is collected to the cleaning container. In this case, the limit (5 g) is not exceeded until approximately 800 sheets are printed, and therefore the threshold Th2=500 can be set, for example.

In this manner, the threshold TH1 is set to a value corresponding to the amount of toner that can continually adhere to the secondary transfer roller 25. Also, the threshold TH2 is set to a value corresponding to the amount of toner that can be stored in the cleaning container (collection container).

<Image Forming Control>

Figure 14:
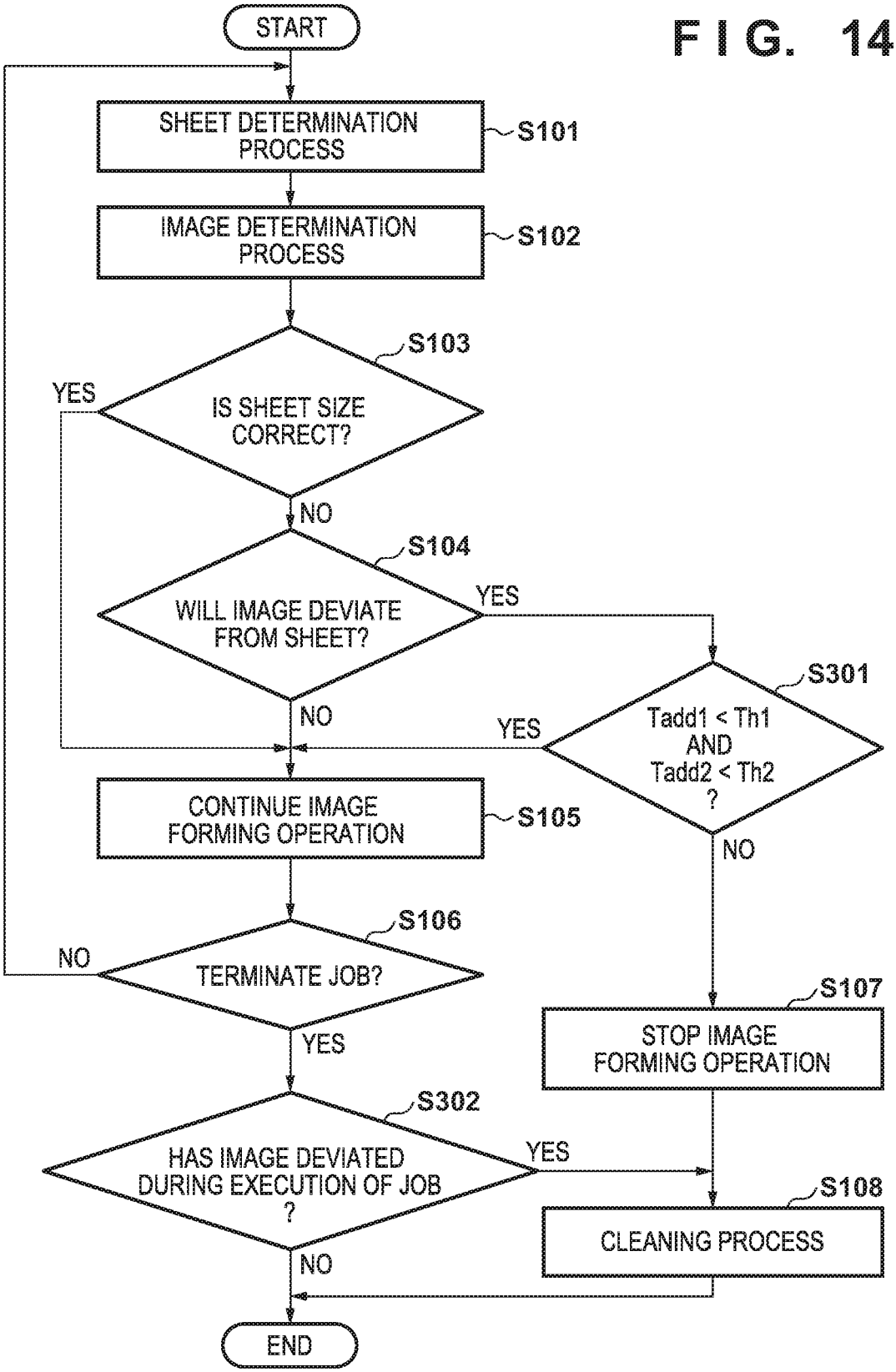
FIG. 14 is a flowchart illustrating a control procedure for an image forming operation (Embodiment 3).

FIG. 14 is a flowchart illustrating a control procedure for the image forming operation according to the present embodiment. Each step in FIG. 14 is achieved by the CPU 94 reading and executing the program stored in the memory 95, for example.

At S101 to S106, the CPU 94 performs the same processes as in Embodiment 1. In the present embodiment, at S104, when it is determined that the image deviates from the sheet, the process advanced to S301.

At S301, the CPU 94 compares the first management value Tadd1 with the threshold Th1 and compares the second management value Tadd2 with the threshold Th2. In a case where both management values do not exceed the respective thresholds (Tadd1<Th1 and Tadd2<Th2), the CPU 94 advances the process to S105. In this case, the image forming operation is continued even if there is a deviation of the image, on the assumption that there is no possibility of fouling with the toner inside the image forming apparatus.

On the other hand, in a case where any of the management values exceeds the corresponding threshold, the CPU 94 advances the process from S301 to S107 and stops the image forming operation, on the assumption that fouling with the toner may occur inside the image forming apparatus due to the occurrence of image deviation. In the case where the image forming operation is stopped at S107, the CPU 94 further performs the cleaning process on the secondary transfer roller 25 (S108) and terminates the process as in Embodiment 1.

In the present embodiment, in a case where the CPU 94 terminates the image forming job ("YES" at S106), the CPU 94 advances the process to S302 and determines whether or not the image has deviated during the execution of the image forming job. If the image has not deviated, the CPU 94 terminates the process. If the image has deviated, the CPU 94 advances the process to S108 to perform the cleaning process and thereafter terminates the process.

As described above, in the present embodiment, in the case where there is no (or low) possibility of fouling with the toner inside the image forming apparatus, the image forming operation is continued even if the formed image is transferred with a deviation from the sheet. Specifically, in the case where it is determined that the first management value Tadd1 does not exceed the threshold Th1 and that the second management value Tadd2 does not exceed the threshold Th2 during the execution of one image forming job, the image forming operation is continued even if it is determined that the image is to be formed with a deviation from the sheet being conveyed. Thus, unnecessary stop of the image forming operation can be avoided, and the frequency of the cleaning operation associated with the stop of the image forming operation can be reduced. Therefore, it is possible to prevent the occurrence of fouling due to the image deviation inside the image forming apparatus while maintaining the productivity of the image forming apparatus. It is possible to reduce the possibility of the fouling inside the apparatus due to outflow of the toner from the container when the cleaning container is filled to capacity earlier than expected.

Embodiment 4

In Embodiment 3, as the first and second management values Tadd1 and Tadd2, the number of times the image has deviated from the sheet (the number of sheets with image deviation) is used. In contrast, in Embodiment 4, an example is described in which the management accuracy of the amount of toner that has been transferred with a deviation from the sheet is improved by using the toner amount as first and second management values Tadd11 and Tadd12. In the following, descriptions of parts common to Embodiment 3 will be omitted.

<Management Values Tadd11 and Tadd12>

In the present embodiment, as in Embodiment 3, two management values (the first management value Tadd1 and the second management value Tadd2) are used to manage the amount of toner that is transferred with a deviation from the sheet.

The CPU 94 integrates the amount of toner forming the image portion deviated from the sheet (the toner that has been transferred with a deviation from the sheet) during the execution of one image forming job and manages the integrated amount as the first management value Tadd11. The Tadd11 is reset to zero each time the cleaning process of the secondary transfer roller 25 is performed. The CPU 94 also integrates the amount of toner that has been transferred with a deviation from the sheet in a period until the cleaning container (cleaning unit 27) is replaced and manages the integrated amount as the second management value Tadd12. Tadd12 is reset to zero each time the cleaning container is replaced with a new container.

<Method of Calculating Toner Amount>

As illustrated in the exemplary system configuration of FIG. 2, a print command (image forming job) transmitted from the PC 110 is transferred to the video controller 91. In this print command, the size of the sheet used for image formation is designated. Input image data included in the print command is converted to exposure data and transferred to the exposure control unit 93 and transferred also to the CPU 94. The CPU 94 can identify the exposure intensity and the exposure position on the basis of the transferred exposure data and can calculate the exposure area from the exposure position.

Figure 15A:
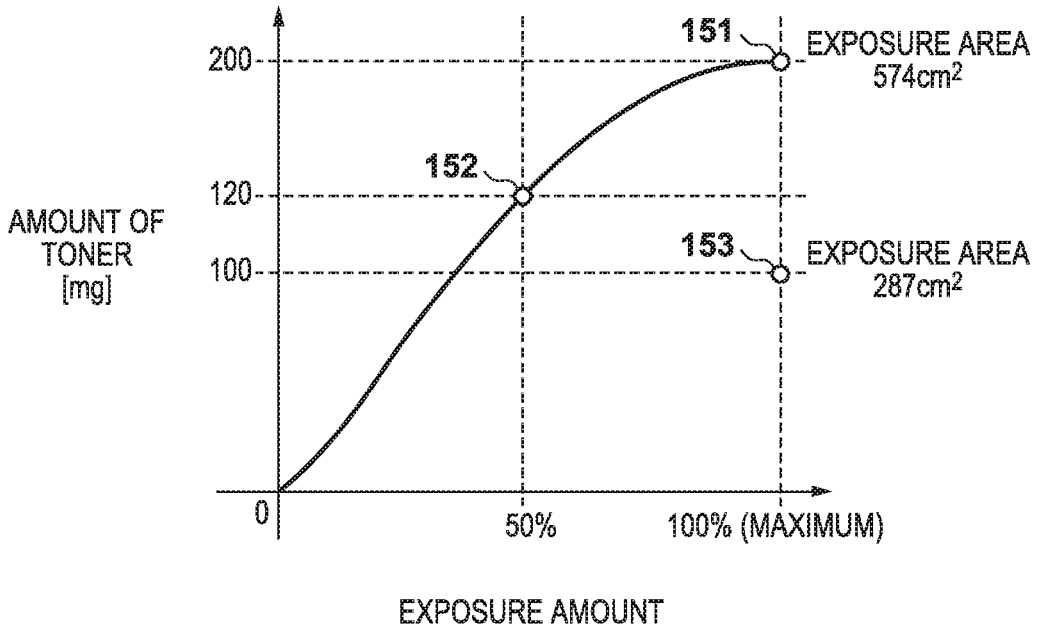
FIGS. 15A and 15B are diagrams illustrating an exemplary relationship between an exposure intensity and a toner amount (Embodiment 4).
Figure 15B:
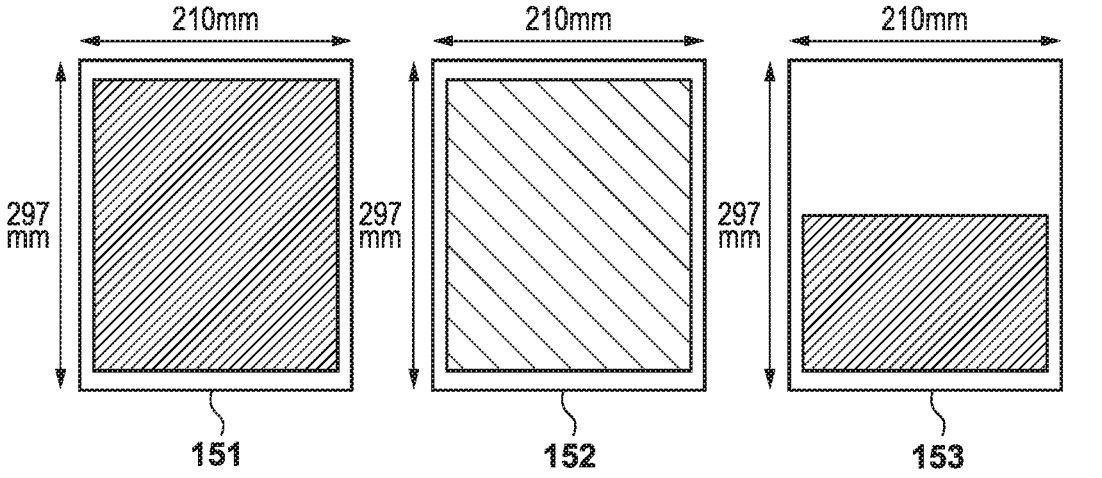

In the present embodiment, the relational expression between the amount of toner to be transferred and the exposure intensity (exposure amount) per unit area is determined in advance as illustrated in FIG. 15A. The CPU 94 calculates the amount of toner from the exposure intensity and the exposure area by using the relational expression. Here, FIG. 15B illustrates exemplary exposure data. Exposure data 151 is exposure data for a case where the exposure intensity is maximum and the exposure area is the A4 size. Exposure data 152 is exposure data for a case where the exposure intensity is ½ of the maximum intensity and the exposure area is the A4 size. Exposure data 153 is exposure data for a case where the exposure intensity is maximum and the exposure area is ½ of the area of the A4 size. The toner amounts corresponding to the exposure data 151, 152, and 153 are determined as 200 mg, 120 mg and 100 mg, respectively from the relational expression illustrated in FIG. 15A.

Figure 16A:
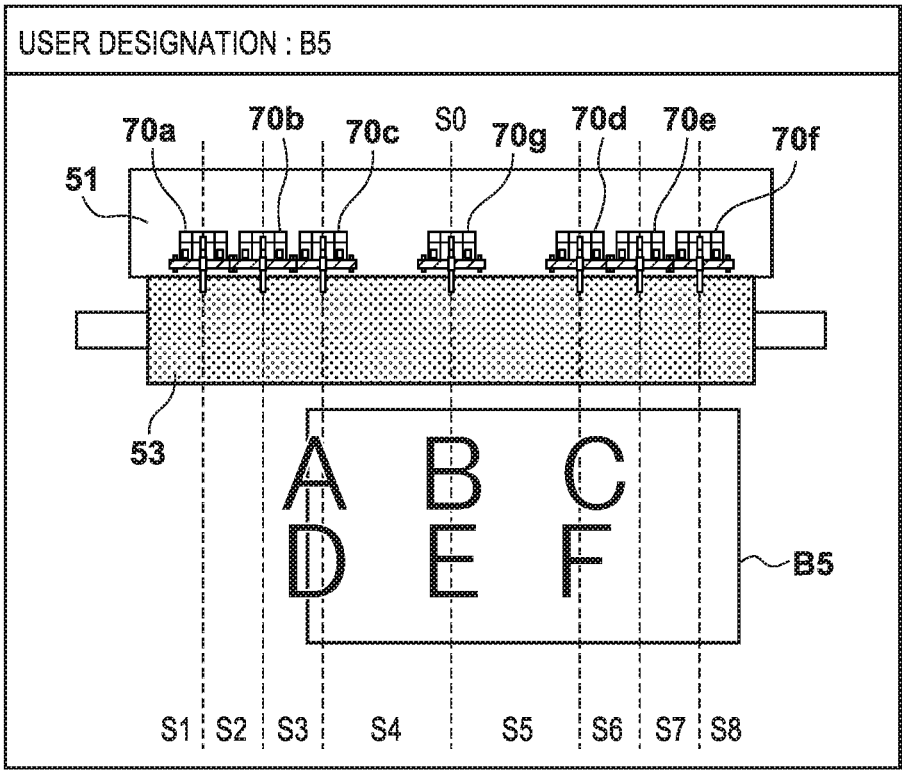
FIGS. 16A and 16B are diagrams illustrating an exemplary calculation of the amount of toner to be transferred with a deviation from a sheet (Embodiment 4).
Figure 16B:
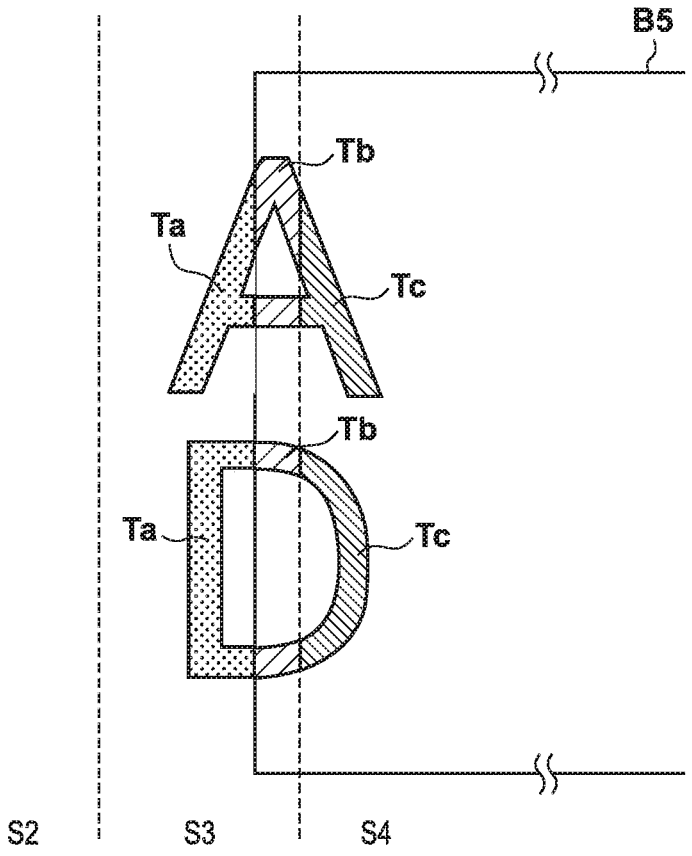

Next, FIGS. 16A and 16B are diagrams illustrating an exemplary calculation of the amount of toner that is transferred with a deviation from the sheet. Here, an example is described in which an image region to be transferred with a deviation from the sheet is identified, and the amount of toner to be transferred with a deviation from the sheet is calculated from the exposure intensity and the exposure area in the image region. As illustrated in FIG. 16A, a case is assumed in which the user sets a B5 sheet on one side in the sheet width direction in the sheet cassette 16 and a portion of the image to be formed is present at an end of the B5 sheet. In this case, the toner is transferred with a deviation from the sheet. The amount of toner that is transferred with a deviation from the sheet is acquired as follows.

As in the embodiment described above, the sheet region (the region where the toner is transferred with a deviation from the sheet) where the difference between the determination result of the sheet determination process and the determination result of the image determination process is "−1". In an example of FIG. 16A, a sheet region S3 is identified as a region where the toner is transferred with a deviation from the sheet. In an example of FIG. 16B, sheet regions S2 to S4 are illustrated in an enlarged manner. In the present embodiment, a portion of alphabets "A" and "D" is formed as an image (toner image) in the sheet region S3. Here, as illustrated in FIG. 16B, the image that is not printed on the sheet is defined as Ta, the image printed on the sheet in the region S3 as Tb, and the image printed on the sheet in the S4 region as Tc. Since the CPU 94 cannot identify the position of the end of the sheet in the sheet width direction, and as such the CPU 94 identifies the Ta and Tb in the sheet region S3 as images that deviates from the sheet.

The CPU 94 determines the exposure intensity and the exposure area of the images Ta and Tb from the exposure data and further determines the corresponding toner amount (the amount of toner that is transferred with a deviation from the sheet) from the relational expression illustrated in FIG. 15A. Here, it is assumed that both the images Ta and Tb are formed with the maximum exposure intensity, and that the total exposure area is 1 $cm^2$. In this case, the corresponding toner amount can be calculated as 200 [mg/574 $cm^2$]×1 [$cm^2$]=0.348 [mg]. For example, if the image forming operation is repeated for 10 sheets under this condition, the total amount of toner that is transferred with a deviation from the sheet can be calculated as 3.48 mg.

<Thresholds Th11 and Th12>

In the present embodiment, a threshold Th11 for comparison with the first management value Tadd11 and a threshold Th12 for comparison with the second management value Tadd12 are prepared.

The threshold Th11 is a value that can be set by a preliminarily conducted experiment. Specifically, as in Embodiment 3, the image is transferred with a deviation from the sheet, and then the number of sheets that have been printed at the time when the toner drops from the secondary transfer roller 25 inside the apparatus is confirmed. In addition, whether fouling on the back of the sheet occurs during subsequent printing is confirmed.

For example, assume a case of an output of a typical user in which an image of the A4 size on which a toner of 0.01 mg/$cm^2$ for each color, i.e., a toner of 0.04 mg/$cm^2$ in total is put is continuously printed on sheets with a shorter sheet width relative to the image. In addition, assume that the sheet size is 148 mm in width and 297 mm in length. In one example experiment, it was confirmed that the toner drops from the secondary transfer roller 25 inside the apparatus during printing on the seventeenth sheet. In addition, it was confirmed that fouling on the back of the sheet occurs when continuous printing is terminated and then printing is restarted using an A4 sheet. On the other hand, neither fouling with the toner inside the apparatus nor fouling on the back of the sheet occurred during printing on the tenth sheet.

Here, it is assumed that the amount of toner used per A4 sheet is 23 mg and that approximately 17 mg of the toner is transferred to the sheet while approximately 6 mg of the toner deviates from the sheet. In this case, as an example, the threshold Th11=6 [mg]×10 [sheet]=60 [mg] can be set. Thus, the image forming operation can be continued until the amount of toner that is transferred with a deviation from the sheet reaches 60 mg during the execution of one image forming job.

The threshold Th12 is a volume of the cleaning container for the intermediate transfer belt 13, which is capable of collecting the toner transferred with a deviation from the sheet, and the threshold Th12 can be set as the threshold Th12=5 [g], for example.

Thus, the threshold TH11 is set to the amount of toner that can continually adhere to the secondary transfer roller 25. Also, the threshold TH12 is set to the amount of toner that can be housed in a cleaning container (collection container).

<Image Forming Control>

The control procedure for the image forming operation according to the present embodiment is the same as that of Embodiment 3 (FIG. 14). The present embodiment differs from Embodiment 3 in that, at S301, the first management value Tadd11 and the threshold Th11 are compared with each other and the management value Tadd12 and the threshold Th12 are compared with each other. At S308, the CPU 94 advances the process to S105 in a case where both management values do not exceed the respective thresholds (Tadd11<Th11 and Tadd12<Th12). In this case, the image forming operation is continued even if there is a deviation of the image, on the assumption that there is no possibility of fouling with the toner inside the image forming apparatus.

On the other hand, in a case where any of the management values exceeds the corresponding threshold, the CPU 94 advances the process from S301 to S107 and stops the image forming operation, on the assumption that fouling with the toner may occur inside the image forming apparatus due to the occurrence of image deviation. In the case where the image forming operation is stopped at S107, the CPU 94 further performs the cleaning process on the secondary transfer roller 25 (S108) and terminates the process as in Embodiment 1.

As described above, in the present embodiment, the image forming operation is controlled by directly using the amount of toner that is transferred with a deviation from the sheet, in comparison with Embodiment 3. Specifically, in the case where it is determined that the first management value Tadd11 does not exceed the threshold Th11 and that the second management value Tadd12 does not exceed the threshold Th12 during the execution of one image forming job, the image forming operation is continued even if it is determined that the image is formed with a deviation from the sheet being conveyed. Thus, the management accuracy of the amount of toner that has been transferred with a deviation from the sheet can be improved, and the productivity of the image forming apparatus can be increased in comparison with Embodiment 3.

Embodiment 5

As illustrated in FIGS. 1, 4A, and 4B, in Embodiments 1 to 4, an example is described in which the sheet detection sensor 70 is provided at a position where the presence or absence of the sheet discharged downstream of the nip N of the fixing unit 50 in the sheet conveyance direction is detected. In Embodiment 5, an example is described in which the sheet detection sensor 70 is disposed at a position different from the position of Embodiments 1 to 4. In the following, descriptions of parts common to Embodiments 1 to 4 will be omitted.

Figure 17:
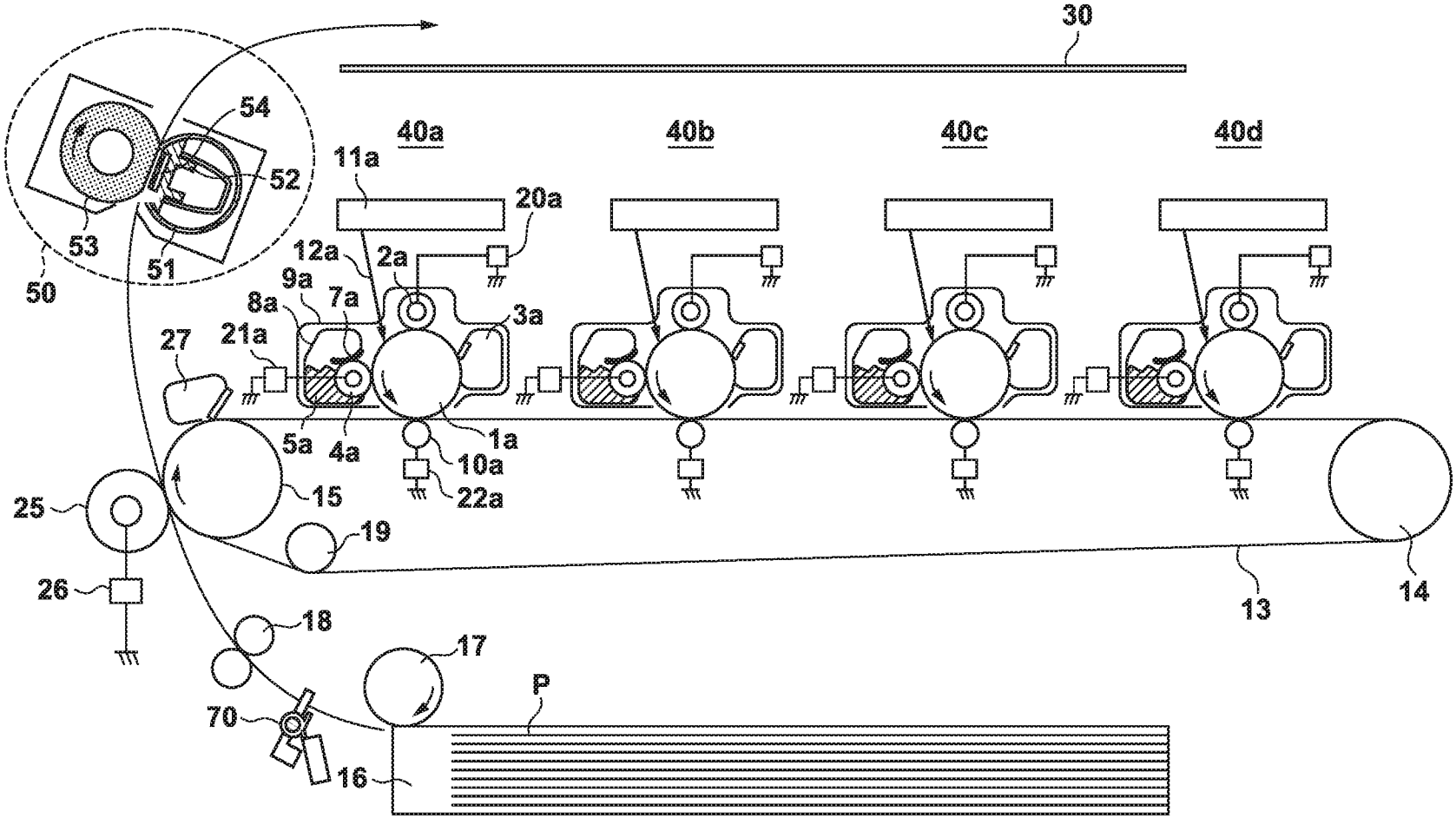
FIG. 17 is a sectional view illustrating an exemplary schematic hardware configuration of the image forming apparatus (Embodiment 5).

FIG. 17 is a cross-sectional view illustrating an exemplary schematic hardware configuration of the image forming apparatus of Embodiment 5. As illustrated in FIG. 17, in the image forming apparatus of the present embodiment, the sheet detection sensor 70 is disposed immediately after the sheet feed roller 17 (a position upstream of the registration roller 18 and downstream of the sheet feed roller 17 in the sheet conveyance direction) at a midpoint in the conveyance path of the sheet P. In this manner, the sheet detection sensor 70 is disposed at a position upstream, in the sheet conveyance direction, of a transfer position (the nip between the intermediate transfer belt 13 and the secondary transfer roller 25) where an image is transferred from the intermediate transfer belt 13 to the sheet.

Also with such an arrangement of the sheet detection sensor 70, the control can be performed as in Embodiments 1 to 4 while achieving the same advantage. In addition, by disposing the sheet detection sensor 70 as upstream as possible in the sheet conveyance direction, the presence or absence of the sheet being conveyed can be detected at an earlier time, and mismatch between the sheet size and the image size can be determined at an earlier time.

Embodiment 6

In Embodiment 6, an example is described in which the sheet determination process described in Embodiment 1 is performed using a thermistor (temperature detection element) provided in a fixing device (fixing unit 50) according to Embodiment 6. In the following, descriptions of parts common to Embodiments 1 to 5 will be omitted.

Figure 18A:
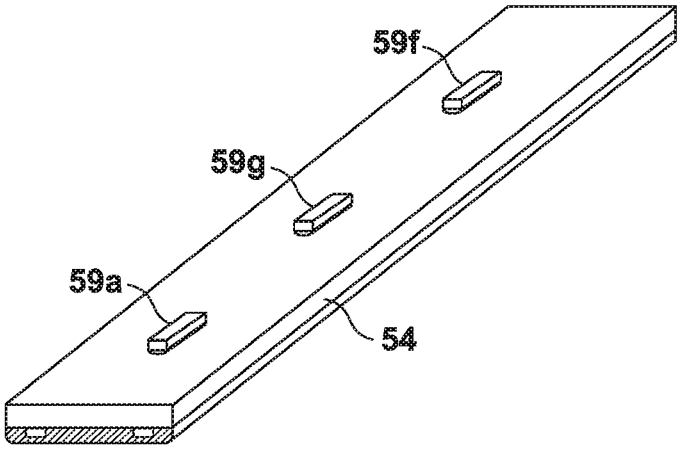
FIGS. 18A and 18B are diagrams illustrating an exemplary arrangement of a thermistor provided in a fixing unit (Embodiment 6).

FIG. 18A is a perspective view illustrating an exemplary arrangement of the thermistor provided in the fixing unit 50 of the present embodiment. The fixing unit 50 includes a thermistor 59 (59*a*, 59*g*, and 590 that measures the temperature inside the fixing unit 50. The thermistor 59*g* is a main thermistor used for controlling the fixation temperature, and the thermistors 59*a* and 59*f* are used as sub-thermistors. The thermistors 59*a*, 59*g*, and 59*f* are arranged in a line along the sheet width direction in the state where the thermistors 59*a*, 59*g*, and 59*f* are in contact with the back surface of the heater 54.

Figure 18B:
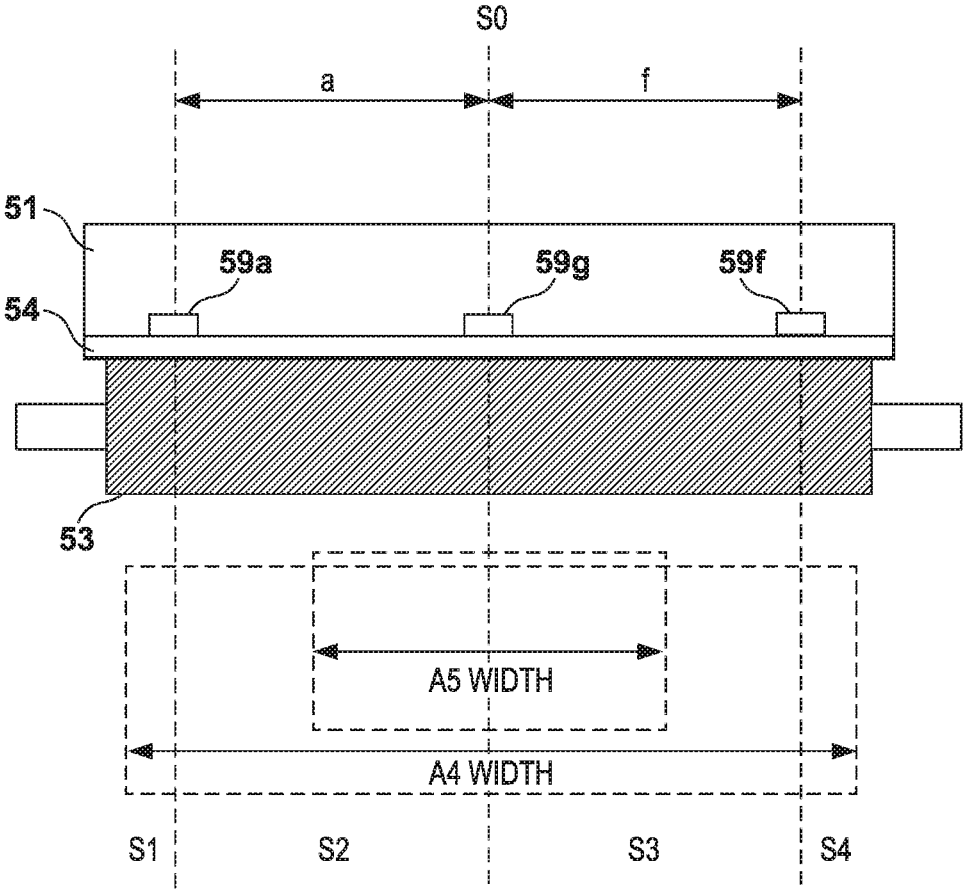

FIG. 18B illustrates an exemplary arrangement of each thermistor 59 in the sheet width direction, and illustrates a positional relationship between the sheet and each thermistor 59 in the case where a sheet with the A5 width (148 mm) and a sheet with the A4 width (210 mm) are conveyed. In the present embodiment, in the sheet width direction, the thermistor 59*g* is disposed at the center position S0 of the conveyance path and the sub-thermistors 59*a* and 59*f* are disposed near both ends of the conveyance path. A distance a between the center position S0 and the thermistor 59*a* and a distance f between the center position S0 and the thermistor 59*f* are each 100 mm, for example. In this manner, the thermistors 59*a*, 59*g*, and 59*f* are disposed at respective positions that are same as the positions of the sheet detection sensors 70*a*, 70*g*, and 70*f* in Embodiment 1 (FIG. 4B, FIG. 6A, and FIG. 7A) in the sheet width direction. In addition, as in Embodiment 1, the region in the sheet width direction is divided into four sheet regions, and these sheet regions are defined as S1 to S4.

The thermistors 59*a*, 59*g*, and 59*f* are capable of detecting the sheet being conveyed in respective regions (sheet regions S1 to S4) sectioned in the sheet width direction as with the sheet detection sensors 70*a*, 70*g*, and 70*f* in Embodiment 1. As illustrated in FIG. 18B, when a sheet with the A4 width that passes through all of the positions of the thermistors 59*a*, 59*g*, and 59*f* is conveyed into the fixing unit 50, heating by the heater 54 and heat dissipation to the sheet are substantially identical at all positions of the thermistors. As a result, the outputs of the thermistors 59 indicate substantially equal temperatures. On the other hand, when a sheet with the A5 width smaller than A4 width is conveyed into the fixing unit 50 and the sheet does not pass through the positions of the thermistors 59*a* and 59*f* as illustrated in FIG. 18B, heat dissipation from the heater 54 to the sheet does not occur at the positions of the thermistors 59*a* and 59*f*. As a result, the outputs of the thermistors 59*a* and 59*f* indicate a temperature higher than the output of the thermistor 59*g*.

In the present embodiment, the CPU 94 detects the sheet being conveyed in the corresponding region of the sheet regions S1 to S4 on the basis of the difference (temperature difference) between the outputs of a plurality of the thermistors 59 described above. Specifically, the CPU 94 monitors the difference between the output of the thermistor 59*g* and each output of the thermistors 59*a* and 59*f*. If the difference in the output indicates a temperature difference greater than a predetermined threshold (e.g., 20° C.), the CPU 94 determines that there is no sheet at the position of the corresponding sub-thermistor 59*a* or 59*f*. On the other hand, if the difference in the output indicates a temperature difference equal to or smaller than the predetermined threshold, the CPU 94 determines that there is a sheet at the position of the corresponding sub-thermistor 59*a* or 59*f*. In this manner, the presence or absence of the sheet conveyed on the conveyance path can be determined using the thermistor 59.

According to the present embodiment, the sheet determination process (the process of determining the presence or absence of the sheet being conveyed in each of the sheet regions S1 to S4 sectioned in the sheet width direction) can be performed using the plurality of thermistors 59 as in Embodiment 1. In other words, the apparatus cost can be reduced since the sheet determination process can be achieved by using the thermistor 59 that is used for temperature control in the fixing unit 50 as the sheet detection sensor without disposing the sheet detection sensor on the conveyance path. In addition, the control can be performed as in Embodiments 1 to 4 on the basis of such a sheet determination process while achieving the same advantage.

Embodiment 7

In Embodiment 7, an example is described in which the sheet determination process is performed using the combination of the sheet detection sensor 70 of Embodiments 1 to 5 and the thermistor 59 of Embodiment 6. In the following, descriptions of parts common to Embodiments 1 to 6 will be omitted.

Figure 19:
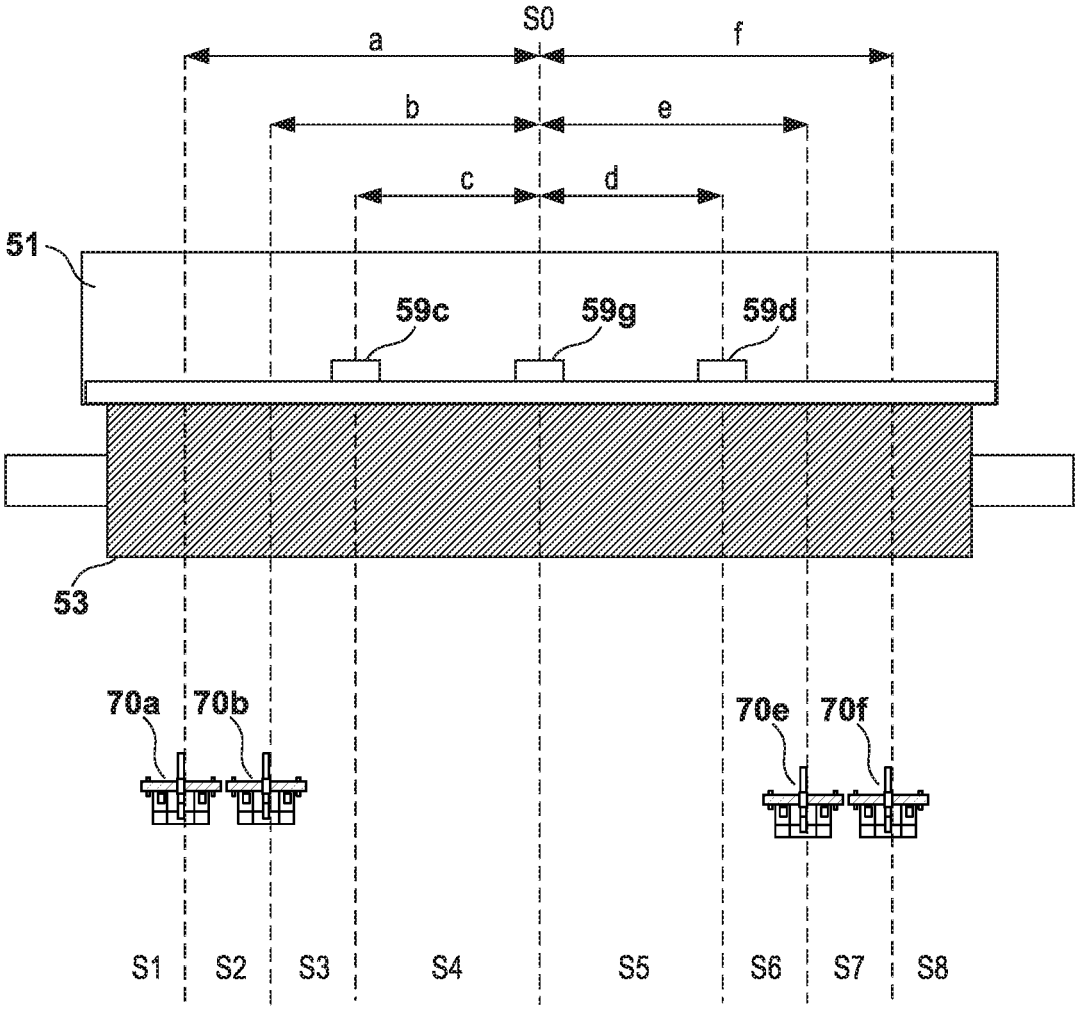
FIG. 19 is a diagram illustrating an exemplary arrangement of the sheet detection sensor and the thermistor (Embodiment 7).

With reference to FIG. 19, an exemplary arrangement of the sheet detection sensor 70 and the thermistor 59 according to the present embodiment will be described. In the example illustrated in FIG. 19, in the sheet width direction, the thermistor 59*g* is disposed at the center position S0 of the conveyance path, and the thermistors 59*c* and 59*d* are disposed at positions separated from the center position S0 by distances c and d, respectively. Further, in the sheet width direction, the sheet detection sensors 70*a*, 70*b*, 70*e* and 70*f* are disposed at positions separated from the center position S0 by distances a, b, e and f, respectively. In the sheet width direction, the sheet detection sensor 70 and the thermistor 59 are disposed at different positions. In this manner, in the present embodiment, the sheet determination process is performed using the plurality of thermistors 59 used for temperature control in the fixing unit 50 as a part of the plurality of sheet detection sensors in Embodiments 1 to 5.

The sheet determination process can be achieved as in the above-described embodiments on the basis of the outputs of the sheet detection sensor 70 and the thermistor 59 arranged in the above-described manner. In other words, the apparatus cost can be reduced since the sheet determination process can be achieved by using the thermistor 59 used for temperature control in the fixing unit 50 in place of a part of the plurality of sheet detection sensors. In addition, the control can be performed as in Embodiments 1 to 4 on the basis of such a sheet determination process while achieving the same advantage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232833, filed on Dec. 12, 2018, and No. 2019-192136, filed on Oct. 21, 2019, which are hereby incorporated by reference herein in their entirety.

What is claimed is:

1. An image forming apparatus, comprising:

a plurality of sheet detection units provided at different positions along a sheet width direction orthogonal to a conveyance direction of a sheet, the plurality of sheet detection units being configured to detect the sheet conveyed on a conveyance path;

a first determination unit configured to determine, by using the plurality of sheet detection units, a presence or absence of a sheet being conveyed in each of a plurality of regions sectioned in the sheet width direction;

a second determination unit configured to determine, based on input image data, a presence or absence of an image to be formed in each of the plurality of regions;

a third determination unit configured to determine, based on a determination result of the first determination unit and a determination result of the second determination unit, whether or not the image to be formed on the sheet being conveyed is to be formed with a deviation from the sheet in the sheet width direction; and a control unit configured to control an image forming operation in accordance with a determination result of the third determination unit.

2. The image forming apparatus according to claim 1, wherein in a case where, among the plurality of regions, there is a region where it is determined that there is no sheet being conveyed in that region and that there is an image to be formed in that region, the third determination unit determines that the image is to be formed with a deviation from the sheet.

3. The image forming apparatus according to claim 1, wherein the control unit continues the image forming operation in a case where it is determined that the image is to be formed without a deviation from the sheet being conveyed; and the control unit stops the image forming operation in a case where it is determined that the image is to be formed with a deviation from the sheet being conveyed.

4. The image forming apparatus according to claim 3, wherein in the case where it is determined that the image is to be formed with the deviation from the sheet being conveyed, the control unit stops the image forming operation after discharging the sheet on which the image has been formed.

5. The image forming apparatus according to claim 3, further comprising:

an image bearing member on which an image to be transferred to the sheet being conveyed is to be formed;

a transfer unit configured to transfer the image formed on the image bearing member to the sheet; and a collection container to which toner remaining on the image bearing member is collected, wherein if the control unit stops the image forming operation, the control unit performs a cleaning process in which toner adhered to the transfer unit from the image bearing member is reverse-transferred to the image bearing member so as to causing the toner to be collected to the collection container from the image bearing member.

6. The image forming apparatus according to claim 5, wherein in the cleaning process, the toner is reverse-transferred from the transfer unit to the image bearing member by application of a reverse bias voltage to the transfer unit.

7. The image forming apparatus according to claim 5, further comprising a counting unit configured to count a number of sheets on which an image has been formed with a deviation from a sheet, wherein in a case where the number of sheets counted by the counting unit does not exceed a predetermined limit, the control unit continues the image forming operation even when it is determined that an image is to be formed with a deviation from a sheet being conveyed.

8. The image forming apparatus according to claim 7, wherein in a case where the number of sheets counted by the counting unit during execution of one image forming job does not exceed a first threshold and where the number of sheets counted after the collection container has been replaced does not exceed a second threshold, the control unit continues the image forming operation even when it is determined that an image is to be formed with a deviation from a sheet being conveyed.

9. The image forming apparatus according to claim 8, wherein the first threshold is a value corresponding to a toner amount that is allowed to continually adhere to the transfer unit; and the second threshold is a value corresponding to a toner amount that is allowed to be stored in the collection container.

10. The image forming apparatus according to claim 5, further comprising an integration unit configured to integrate an amount of toner that has been transferred with a deviation from a sheet, wherein in a case where an integrated amount obtained by the integration unit does not exceed a predetermined limit, the control unit continues the image forming operation even when it is determined that an image is to be formed with a deviation from a sheet being conveyed.

11. The image forming apparatus according to claim 10, wherein in a case where the integrated amount during execution of one image forming job does not exceed a first threshold and the integrated amount after the collection container has been replaced does not exceed a second threshold, the control unit continues the image forming operation even when it is determined that an image is to be formed with a deviation from a sheet being conveyed.

12. The image forming apparatus according to claim 11, wherein the first threshold is a toner amount that is allowed to continually adhere to the transfer unit; and the second threshold is a toner amount that is allowed to be stored in the collection container.

13. The image forming apparatus according to claim 1, wherein the third determination unit determines whether or not an image to be formed on a sheet being conveyed is to be formed with a deviation from the sheet in a case where a sheet size designated by a user does not match the determination result of the first determination unit.

14. The image forming apparatus according to claim 1, further comprising a fixing unit configured to fix toner, which has been transferred to the sheet conveyed on the conveyance path, to the sheet, wherein the plurality of sheet detection units are provided downstream of the fixing unit in the conveyance direction.

15. The image forming apparatus according to claim 1, wherein each of the plurality of sheet detection units is constituted by a transmissive photosensor, a temperature sensor, or a distance sensor.

16. The image forming apparatus according to claim 1, wherein the plurality of sheet detection units are provided upstream, in the conveyance direction, of a transfer position where an image is transferred to a sheet.

17. The image forming apparatus according to claim 1, further comprising a fixing unit configured to fix toner, which has been transferred to the sheet conveyed on the conveyance path, to the sheet, wherein a plurality of temperature detection elements provided in the fixing unit are used as at least a part of the plurality of sheet detection units, and the first determination unit determines the presence or absence of the sheet being conveyed in a corresponding region among the plurality of regions based on a difference between outputs of the plurality of temperature detection elements.

* * * * *